US012653270B2

(12) United States Patent
Bailly et al.

(10) Patent No.: US 12,653,270 B2
(45) Date of Patent: Jun. 16, 2026

(54) SOLE STRUCTURES AND ARTICLES OF FOOTWEAR INCLUDING BLADDER SYSTEMS WITH CLOSABLE FLUID LINE

(71) Applicant: NIKE, Inc., Beaverton, OR (US)

(72) Inventors: Devin Bailly, Portland, OR (US); Levi J. Patton, Portland, OR (US); Stuart D. Reinhardt, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/961,202

(22) Filed: Nov. 26, 2024

(65) Prior Publication Data

US 2025/0176667 A1 Jun. 5, 2025

Related U.S. Application Data

(60) Provisional application No. 63/604,559, filed on Nov. 30, 2023.

(51) Int. Cl.

| | |
|---|---|
| ***A43B 13/20*** | (2006.01) |
| ***A43B 7/142*** | (2022.01) |
| ***A43B 7/143*** | (2022.01) |
| ***A43B 7/144*** | (2022.01) |

(52) U.S. Cl.

CPC ..... *A43B 13/203* (2013.01); *A43B 7/142* (2013.01); *A43B 7/143* (2013.01); *A43B 7/144* (2013.01); *A43B 13/206* (2013.01)

(58) Field of Classification Search

CPC ..... A43B 13/20; A43B 13/203; A43B 13/206
See application file for complete search history.

(56) References Cited

U.S. PATENT DOCUMENTS

| | | | | |
|---|---|---|---|---|
| 1,929,126 | A * | 10/1933 | Tuki | A43B 13/206 36/28 |
| 4,312,140 | A | 1/1982 | Reber | |
| 4,589,626 | A * | 5/1986 | Kurtz | A61M 39/288 251/10 |
| 5,706,589 | A * | 1/1998 | Marc | A43B 13/182 36/27 |

(Continued)

FOREIGN PATENT DOCUMENTS

WO 2024145326 A1 7/2024

OTHER PUBLICATIONS

Mar. 14, 2025 (WO) International Search Report and Written Opinion—App PCT/US2024/057642, 11 pages.

*Primary Examiner* — Ted Kavanaugh
(74) *Attorney, Agent, or Firm* — Banner & Witcoff, Ltd.

(57) ABSTRACT

Sole structures and articles of footwear include: (a) a foot support bladder chamber; (b) a fluid reservoir chamber; (c) a fluid line extending between the foot support bladder chamber and the fluid reservoir chamber and placing the foot support bladder chamber in fluid communication with the fluid reservoir chamber, wherein the fluid line extends outward from a heel area or a midfoot area of the foot support bladder chamber and/or the fluid reservoir chamber; and (d) a closure element for changing the fluid line between an open configuration and a closed configuration. The closure element may comprise a switch that is pivotally engaged with the footwear upper or sole structure. The fluid line may extend through a flap that projects outward from the heel or midfoot area of the foot support bladder chamber and/or the fluid reservoir chamber.

20 Claims, 22 Drawing Sheets

(56) References Cited

U.S. PATENT DOCUMENTS

| | | | | |
|---|---|---|---|---|
| 6,014,823 | A * | 1/2000 | Lakic | A43B 17/035 36/71 |
| 11,206,896 | B2 * | 12/2021 | Henrichot | A43B 3/38 |
| 11,234,485 | B2 | 2/2022 | Henrichot et al. | |
| 11,653,712 | B2 * | 5/2023 | Costa | A43B 13/203 36/93 |
| 11,969,053 | B2 | 4/2024 | Henrichot et al. | |
| 11,986,053 | B2 | 5/2024 | Henrichot et al. | |
| 2013/0212909 | A1 * | 8/2013 | Bates | A43B 13/203 36/102 |
| 2020/0046071 | A1 | 2/2020 | Henrichot et al. | |
| 2024/0260713 | A1 | 8/2024 | Henrichot et al. | |

* cited by examiner 100
500
102
510
210
516L
510
528R
402
406
208
510H
514R
504
506
502
520
522P
400
404
200P
220
240
230
516M

SOLE STRUCTURES AND ARTICLES OF FOOTWEAR INCLUDING BLADDER SYSTEMS WITH CLOSABLE FLUID LINE

RELATED APPLICATION DATA

This application is a U.S. Non-Provisional application and claims priority to U.S. Provisional Patent Appln. No. 63/604,559 filed Nov. 30, 2023 and entitled "Sole Structures and Articles of Footwear Including Bladder Systems with Closable Fluid Line." U.S. Provisional Patent Appln. No. 63/604,559 is entirely incorporated herein by reference.

FIELD OF THE INVENTION

The present technology relates to bladder systems, foot support systems, sole structures, articles of footwear, and/or other foot-receiving devices. Some more specific aspects of the present technology pertain to bladder systems, foot support systems, sole structures, articles of footwear, and/or other foot-receiving devices that include a fluid line that is openable and closable, e.g., by a switch, clamp, or other device. Additional aspects of this technology relate to methods of making and/or using such bladder systems, foot support systems, sole structures, articles of footwear, and/or other foot-receiving devices.

Aspects of this technology may be used in conjunction with footwear components and footwear structures of the types described and illustrated in U.S. Provisional Patent Appln. No. 63/604,566 and entitled "Bladder Systems with Closable Fluid Line and Foot Supports Including Such Bladder Systems," which application is entirely incorporated herein by reference.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

SUMMARY OF THE INVENTION

This Summary is provided to introduce some general concepts relating to this technology in a simplified form that are further described below in the Detailed Description. This Summary is not intended to identify key features or essential features of the claimed invention.

Aspects of this technology relate to bladder systems, foot support systems, sole structures, articles of footwear, and/or other foot-receiving devices, e.g., of the types described and/or claimed below and/or of the types illustrated in the appended drawings. Such bladder systems, foot support systems, sole structures, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Sole structures and/or articles of footwear in accordance with some examples of this technology may include: (a) a foot support bladder chamber (also called a "foot support bladder portion" herein); (b) a fluid reservoir chamber (also called a "fluid reservoir portion" herein); (c) a first fluid line extending between the foot support bladder chamber and the fluid reservoir chamber and placing the foot support bladder chamber in fluid communication with the fluid reservoir chamber, wherein the first fluid line extends outward (e.g., rearward) from a heel area (e.g., a rear heel area) or a midfoot area of at least one of the foot support bladder chamber or the fluid reservoir chamber; and (c) a closure element for changing the first fluid line between an open configuration and a closed configuration.

Other sole structures and/or articles of footwear in accordance with some examples of this technology may include: (a) a foot support bladder chamber; (b) a fluid reservoir chamber; (c) a first fluid line extending between the foot support bladder chamber and the fluid reservoir chamber and placing the foot support bladder chamber in fluid communication with the fluid reservoir chamber; and (d) a switch. The switch may include: (i) a medial member pivotally engaged with the medial heel region, (ii) a lateral member pivotally engaged with the lateral heel region, and (iii) a contact portion extending around the rear heel region, wherein movement of the switch moves the contact portion and changes the first fluid line between an open configuration and a closed configuration.

Additional aspects of this technology relate to foot support systems that include two or more of: (a) a first sole member (e.g., an outsole) including a first upper-facing surface and a first ground-facing surface; (b) a first bladder portion (e.g., a fluid reservoir chamber or portion) including a second upper-facing surface and a second ground-facing surface, wherein the second ground-facing surface extends over (e.g., is fixed to) the first upper-facing surface; (c) a second sole member (e.g., a midsole) including a third upper-facing surface, a third ground-facing surface, and a sidewall extending between the third upper-facing surface and the third ground-facing surface, wherein the third ground-facing surface extends over (e.g., is fixed to) the second upper-facing surface; (d) a second bladder portion (e.g., a foot support bladder chamber or portion) including a fourth upper-facing surface and a fourth ground-facing surface, wherein the fourth ground-facing surface extends over (e.g., is fixed to) the third upper-facing surface; (e) a footwear component (e.g., a heel counter or other heel support component) having a fifth ground-facing surface, wherein the fifth ground-facing surface extends over the fourth upper-facing surface; (f) a first fluid line extending from the first bladder portion to the second bladder portion; and (g) a second fluid line extending from the first bladder portion to the second bladder portion. At least one of the first upper-facing surface, the third ground-facing surface, the sidewall, the third upper-facing surface, or the fifth ground-facing surface includes: (i) a first recessed surface defined therein, wherein an outer surface of the first fluid line is received in (or located at) the first recessed surface. Additionally, such foot support systems further may include a second recessed surface defined therein, wherein an outer surface of the second fluid line (if present) is received in (or located at) the second recessed surface. Additional recessed surfaces may be provided (e.g., in the first upper-facing surface, the third ground-facing surface, the sidewall, the third upper-facing surface, and/or the fifth ground-facing surface) that face other recessed surfaces to create channels through which the first fluid line and/or the second fluid line (if present) can extend and can be housed without being pinched or crushed.

While some aspects of this technology are described in terms of bladder systems and/or foot support systems, additional aspects of this technology relate to sole structures; articles of footwear; other foot-receiving devices; methods of making such bladder systems, foot support systems, sole structures, articles of footwear, and/or other foot-receiving devices; and/or methods of using such bladder systems, foot support systems, sole structures, articles of footwear, and other foot-receiving devices.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
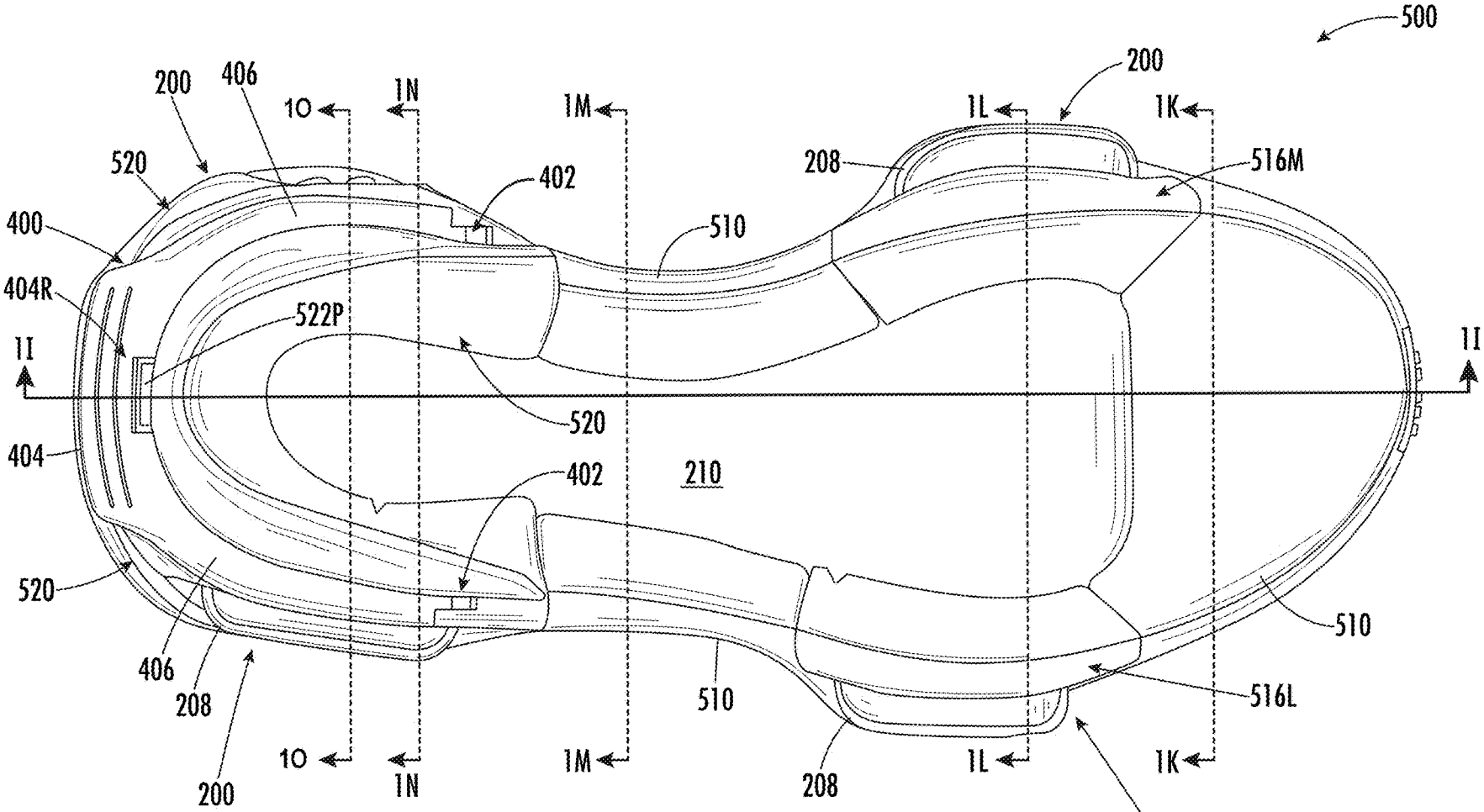
FIGS. 1A-1O and 1Q provide various views of articles of footwear and sole structures in accordance with some examples and aspects of this technology.

In the following description of various examples of footwear structures and components according to the present technology, reference is made to the accompanying drawings, which form a part hereof, and in which are shown by way of illustration various example structures and environments in which aspects of the present technology may be practiced. It is to be understood that other structures and environments may be utilized and that structural and functional modifications may be made to the specifically described structures and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

Various structures and parameters of footwear sole structures and/or articles of footwear are described herein based on a "longitudinal length" parameter L. Note FIG. 1B. The longitudinal length L can be found with the article of footwear (or sole structure or other component) oriented on a horizontal support surface on its ground-facing surface in an unloaded condition (e.g., with no weight applied to it other than weight of other components of the article of footwear, sole structure, or other component). Once so oriented, parallel vertical planes VP that are perpendicular to the horizontal support surface are oriented to contact the rearmost heel (RH) location(s) and the forwardmost toe (FT) location(s) of the article of footwear, upper, sole structure, or another component of interest. The parallel vertical planes VP should be oriented facing one another, e.g., extending into and out of the page of FIG. 1B, and as far away from one another as possible while still in contact with the rearmost heel RH and forwardmost toe FT locations. The direct distance between these vertical planes VPs corresponds to the longitudinal length L of the article of footwear, sole structure, or other component of interest. Locations of various footwear features and/or components are described in this specification based on their respective locations along the longitudinal length L as measured forward from the rear heel vertical plane VP. The rearmost heel location(s) is (are) located at position 0L and the forwardmost toe location(s) is (are) located at position 1L along the longitudinal length L. Intermediate locations along the longitudinal length L are referred to by fractional locations (e.g., 0.33L) along the longitudinal length L measured forward from the rear heel vertical plane VP. The term "parallel planes" as used herein are planes oriented parallel to the vertical planes VP. These parallel planes may intersect the longitudinal length L or longitudinal direction somewhere between P=0L and P=1.0L. Note FIG. 1B, including example parallel plane location designators at 0.33L and 0.67L.

The term "rearward" as used herein means at or toward the heel region of the article of footwear (or component thereof) or other component, and the term "forward" as used herein means at or toward a forefoot or forward toe region of the article of footwear (or component thereof) or other component. Unless otherwise defined: (a) the terms "heel" or "heel region" refer to a back (or rearward) one-third of a sole structure, article of footwear, or other foot-receiving device (between parallel planes at P=0L and P=0.33L); (b) the terms "midfoot" or "arch" refer to a central one-third of a sole structure, article of footwear, or other foot-receiving device (between parallel planes at P=0.33L and P=0.67L); and (c) the terms "forefoot" or "forefoot region" refer to a front (or forward) one-third of a sole structure, article of footwear, or other foot-receiving device (between parallel planes at P=0.67L and P=1L). Also, the term "lateral" means the "little toe" side or outside edge of an article of footwear or component thereof (e.g., an upper, a sole structure, etc.) or other component, and the term "medial" means the "big toe" side or inside edge of an article of footwear or component thereof (e.g., an upper, a sole structure, etc.) or other component.

The term "port," as used herein includes any opening in a component through which fluid (e.g., a gas) may pass to enter or leave that component. Some "ports" may include one or more hardware components or other structures, e.g., to which a fluid line may connect. In some examples of this technology, a fluid line may connect to a "port" of another component by an adhesive, by a hot melt or welded connection (also called "fusing techniques" herein), by a mechanical connector, or the like. In example structures in which a fluid line is integrally formed with another part (such as a pump, a foot support bladder (e.g., a foot support bladder portion), a reservoir component (e.g., a fluid reservoir bladder portion), or other fluid source component), the "port" may be considered the location where the interior chamber changes in size (e.g., changes in transverse cross-sectional area) from a relatively small fluid channel size to a relatively large and more open volume. "Inlets" and "outlets" as those terms are used herein may be considered "ports."

The term "flap" as used herein means a relatively thin portion of a bladder system that defines a fluid line through it, and the "flap" projects outward from a surface of another, larger portion of the bladder system. The fluid line in the "flap" may be open into and in direct fluid communication with an interior chamber of a larger portion of the bladder system from which it extends. A "flap" may contain (and define) a small portion of a fluid line connecting two larger portions of the bladder system. A "flap" may extend to a free edge, and that free edge may be exposed at the exterior of a sole structure and/or an article of footwear. The portion(s) of a "flap" that define the interior channel of a fluid line extending through the flap may constitute portions of a seam (e.g., a weld line or other seam) joining two layers of thermoplastic elastomer material to form the bladder system and fluid line. Thus, the "flap" may comprise an integral portion of the bladder system structure.

In at least some examples of this technology, the fluid line portion defined within a "flap" will have: (i) one half (e.g., an upper half of the fluid line) defined by a first material layer or sheet forming one half of the flap (e.g., an upper half of the flap) and (ii) another half (e.g., a lower half of the fluid line) defined by a second material layer or sheet forming another half of the flap (e.g., a lower half of the flap). Additionally or alternatively, in some examples, a "flap" will be formed by two interfacing surfaces of material (e.g., facing layers or sheets of thermoplastic elastomer material) and the fluid flow direction through the fluid line portion within the flap will extend generally parallel to the two interfacing surfaces. Still additionally or alternatively, a longitudinal length of the fluid line portion within a "flap" may extend generally parallel to interfacing surfaces of material forming the "flap."

This application and/or its claims use the terms, e.g., "first," "second," "third," and the like, to identify certain components and/or features relating to this technology. These terms are used merely for convenience, e.g., to assist in maintaining a distinction between components and/or features of a specific structure. Use of these terms should not be construed as requiring a specific order or arrangement of the components and/or features being discussed. Also, use of these specific terms in the specification for a specific structure does not require that the same term be used in the claims to refer to the same part (e.g., a component or feature referred to as the "third" in the specification may correspond to any numerical adjective used for that component or feature in the claims).

I. General Description of Aspects of this Technology

As noted above, aspects of this technology relate to bladder systems, foot support systems, sole structures, articles of footwear, and/or other foot-receiving devices, e.g., of the types described and/or claimed below and/or of the types illustrated in the appended drawings. Such bladder systems, foot support systems, sole structures, articles of footwear, and/or other foot-receiving devices may include any one or more structures, parts, features, properties, and/or combination(s) of structures, parts, features, and/or properties of the examples described and/or claimed below and/or of the examples illustrated in the appended drawings. Other aspects of this technology relate to foot support systems, sole structures, articles of footwear, and/or other foot-receiving devices that include bladder systems of the types described above and methods of making and/or using such products.

At least some aspects of this technology may include structures and/or may be used in systems of the types described in: (a) U.S. Pat. No. 11,206,896 B2, (b) U.S. Pat. No. 11,234,485 B2, (c) U.S. Provisional Patent Appln. No. 63/477,719 filed Dec. 29, 2022, (d) U.S. Provisional Patent Appln. No. 63/498,593 filed Apr. 27, 2023, and (e) U.S. Provisional Patent Appln. No. 63/541,431 filed Sep. 29, 2023, each of which is entirely incorporated herein by reference.

Given the general description of features, aspects, structures, processes, and arrangements according to certain examples of this technology provided above, a more detailed description of specific example bladder systems, foot support systems, sole structures, articles of footwear, and methods in accordance with this technology follows.

II. Detailed Description of Example Bladder Systems, Sole Structures, Articles of Footwear, and Other Components/Features According to this Technology Referring to the figures and following discussion, various examples of bladder systems, sole structures, articles of footwear, and components thereof in accordance with aspects of this technology are described.

Figure 1B:
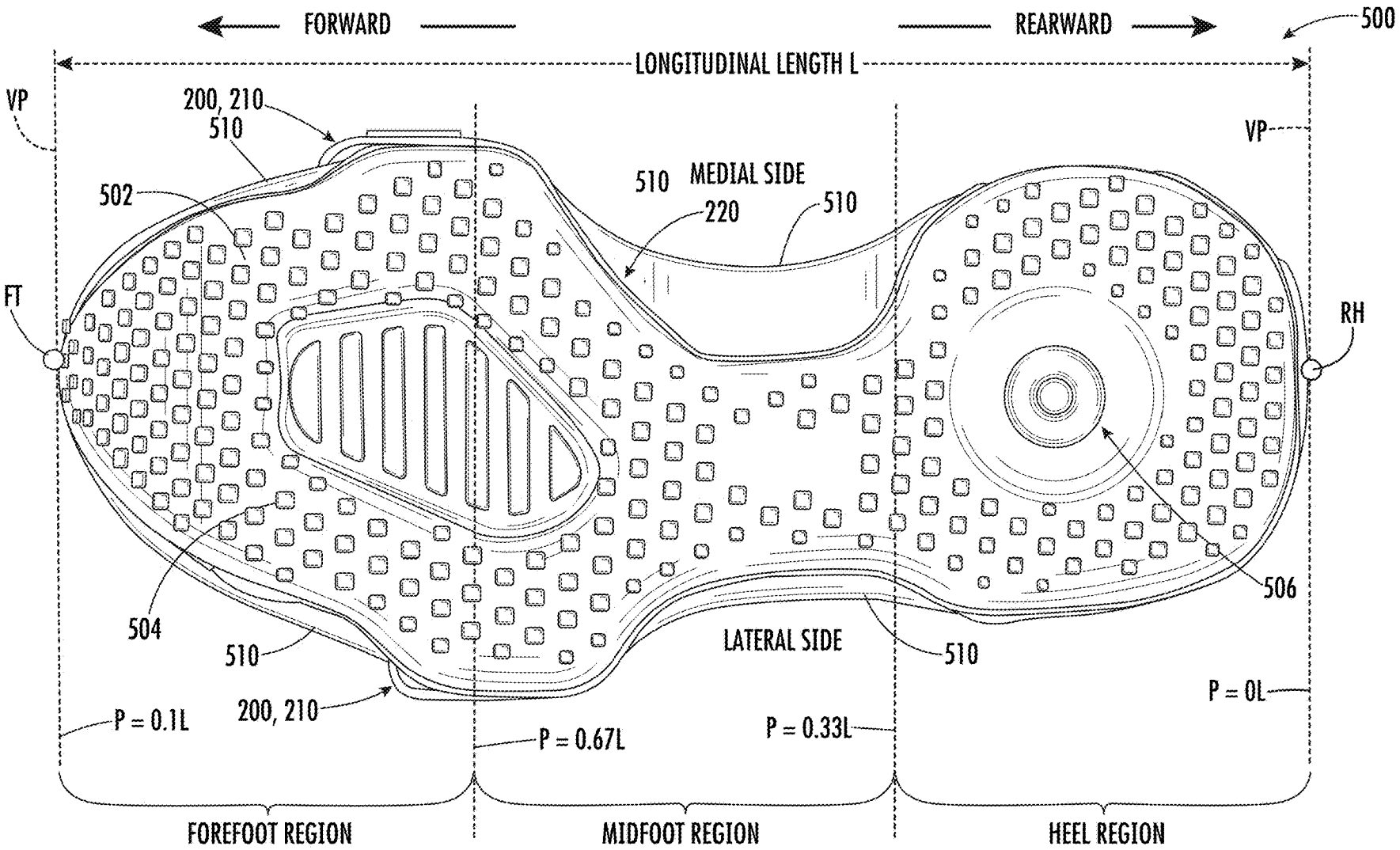
FIG. 1P provides a schematic diagram illustrating movement of fluid in bladder systems incorporated into sole structures and/or articles of footwear in accordance with some examples and aspects of this technology.
Figure 1C:
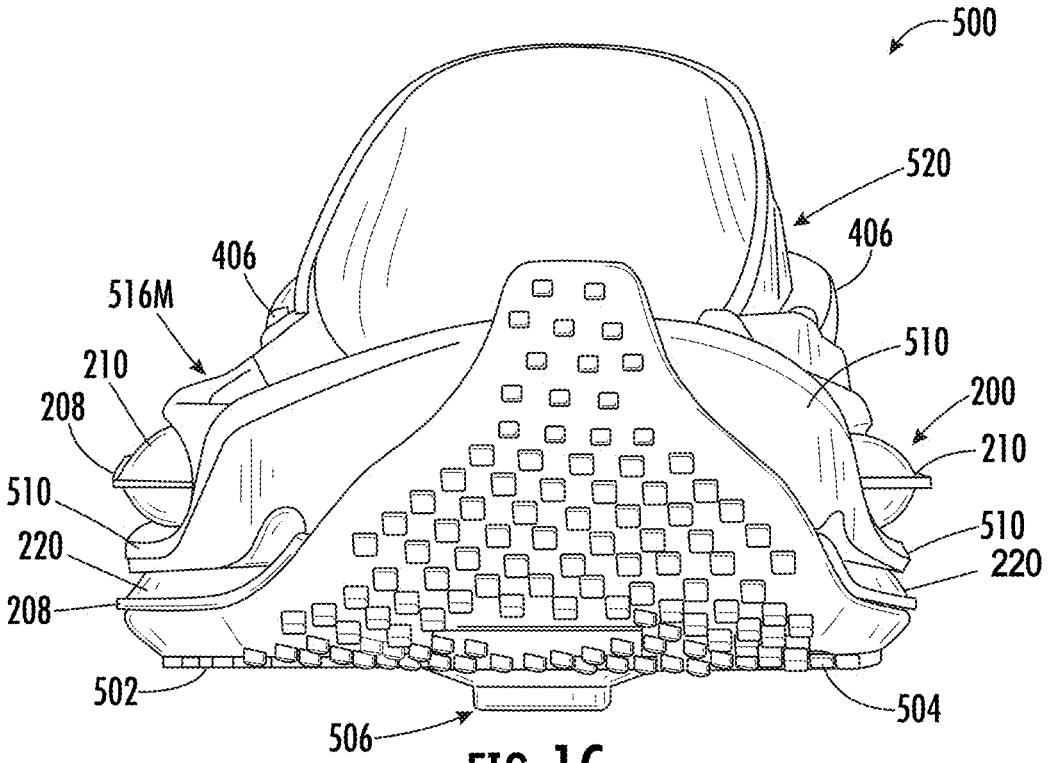
Figure 1D:
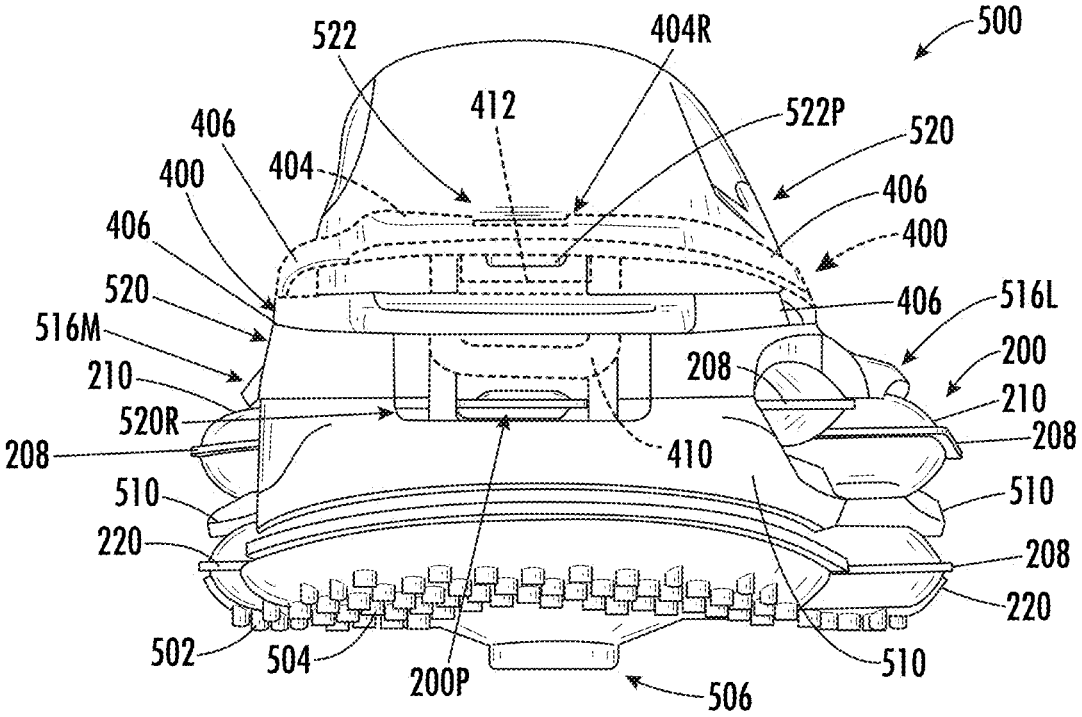
Figures 1E, 1F:
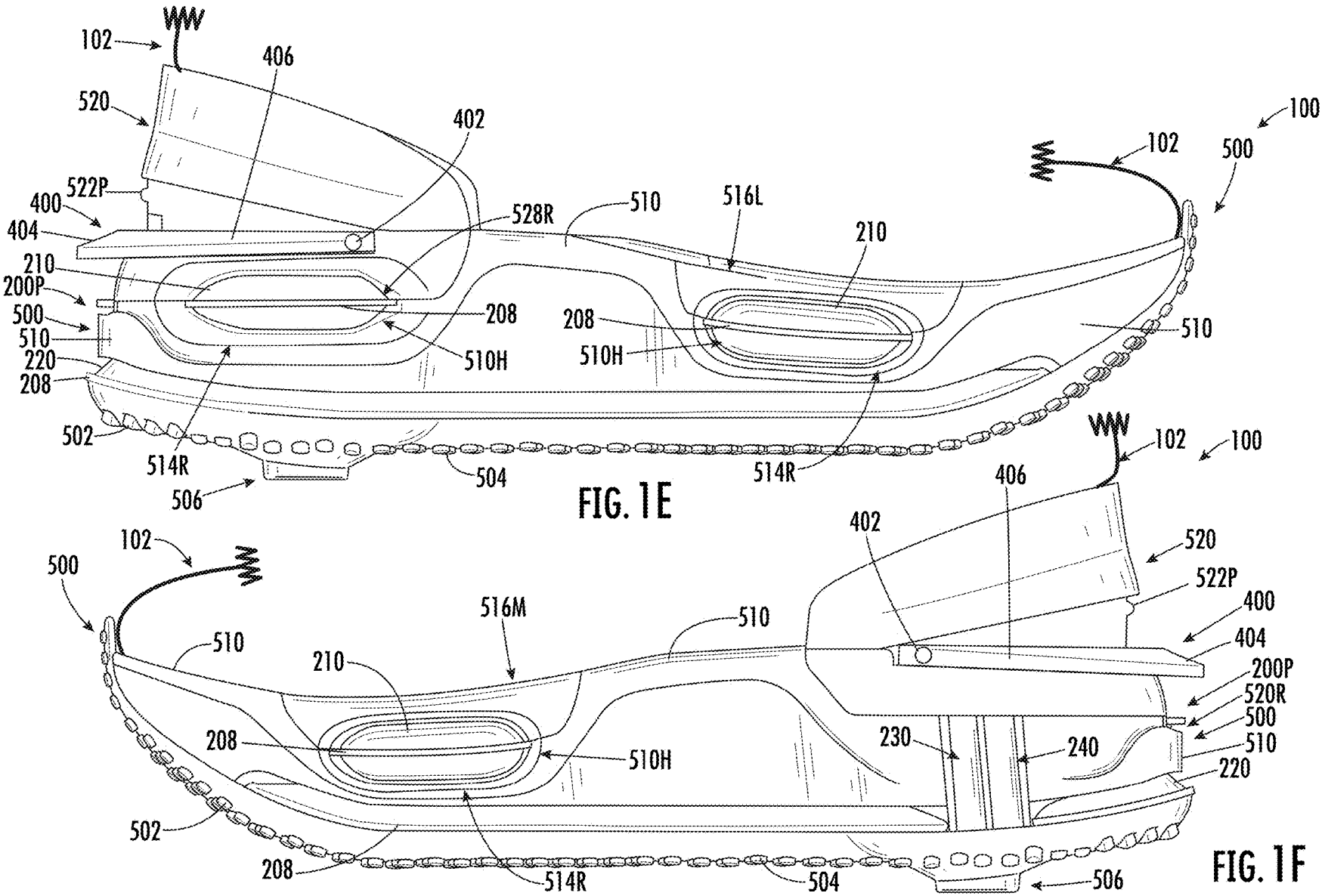
Figure 1G:
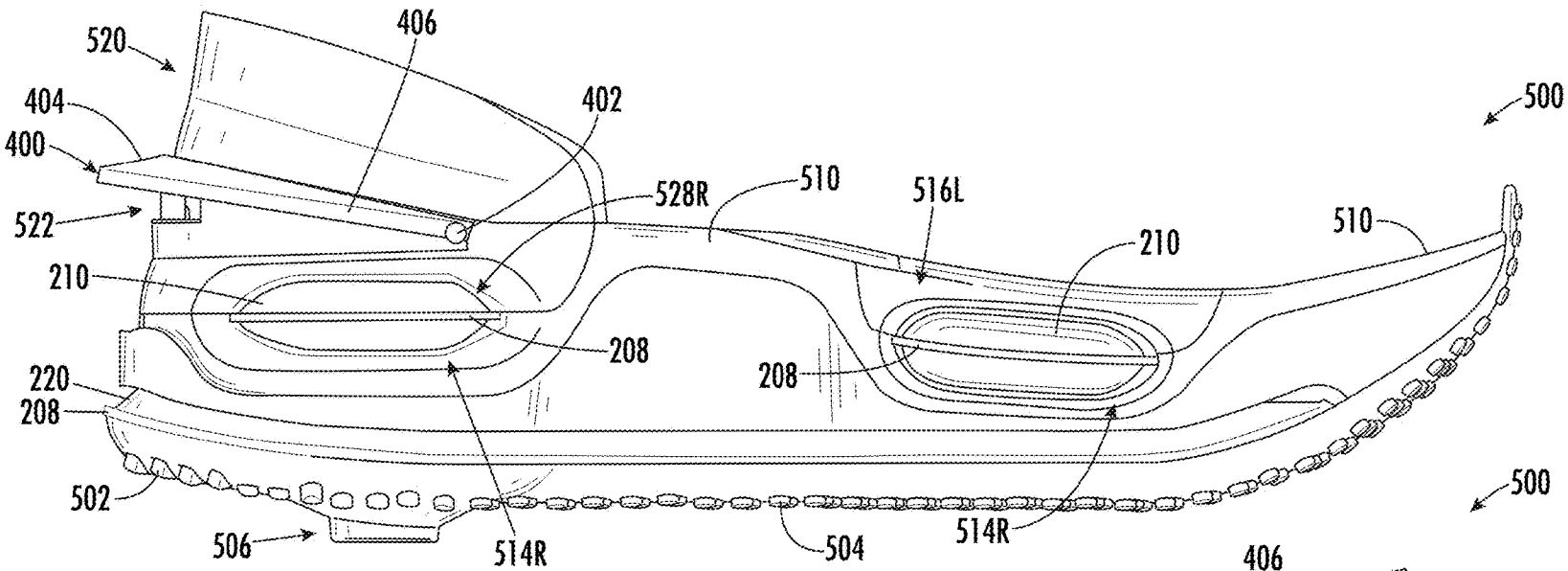
Figure 1H:
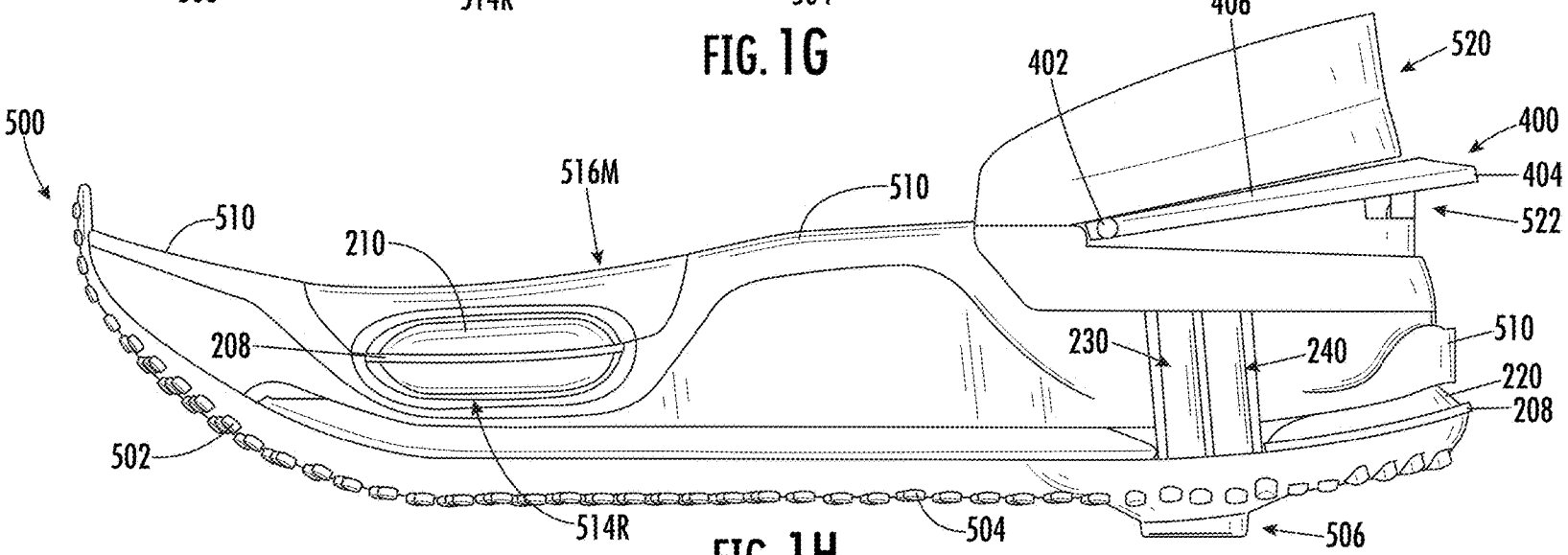
Figure 1I:
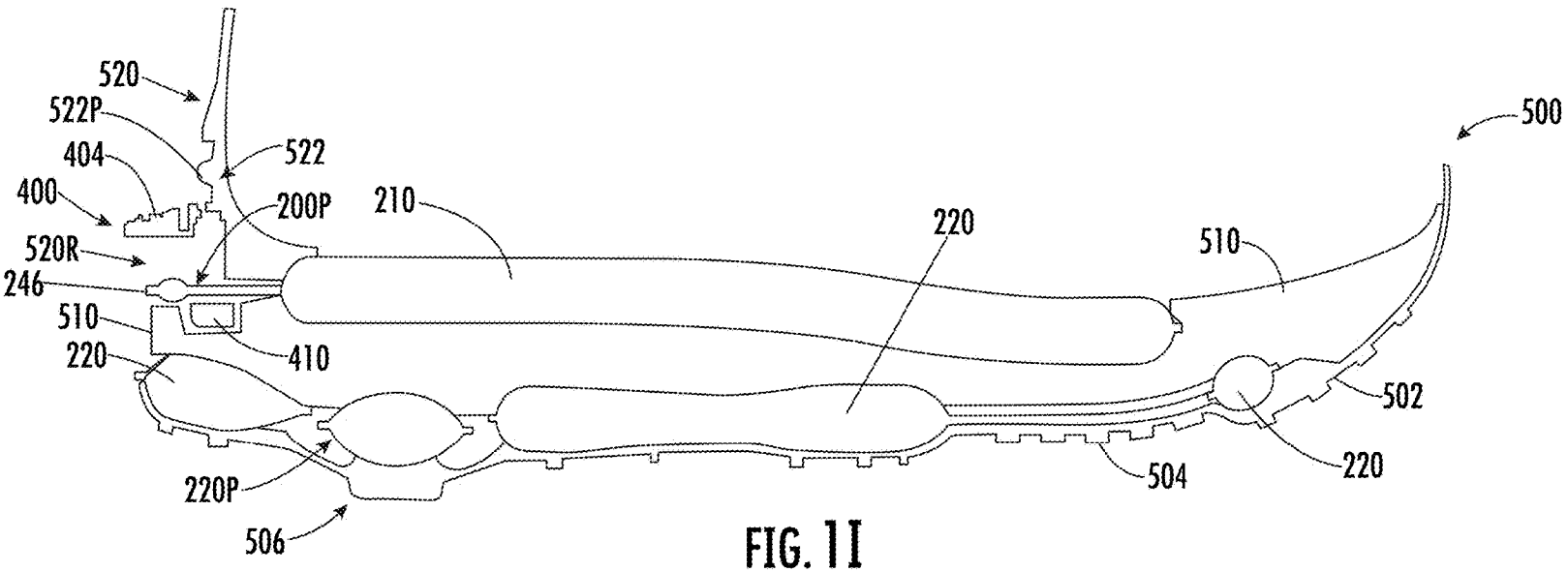
Figure 1J:
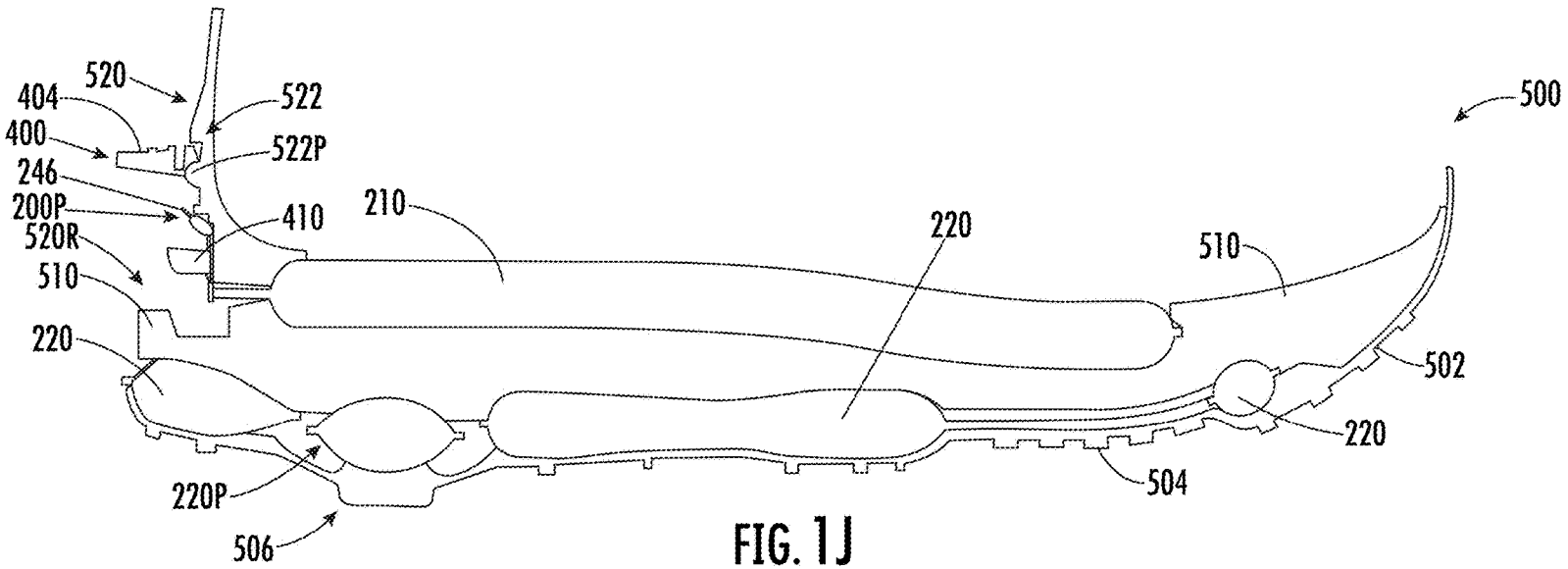
Figure 1M:
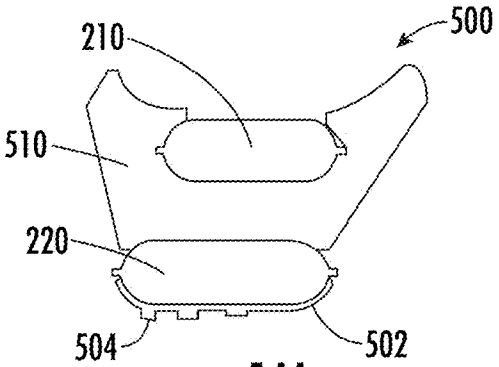
Figure 1L:
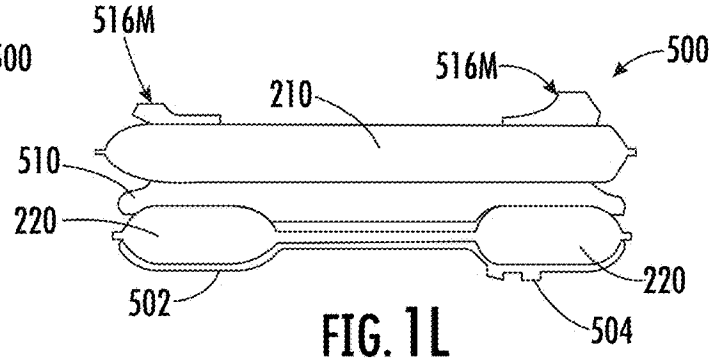
Figure 1K:
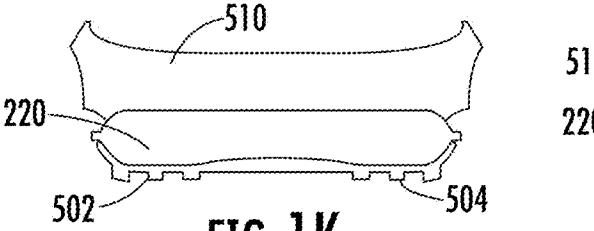
Figure 1O:
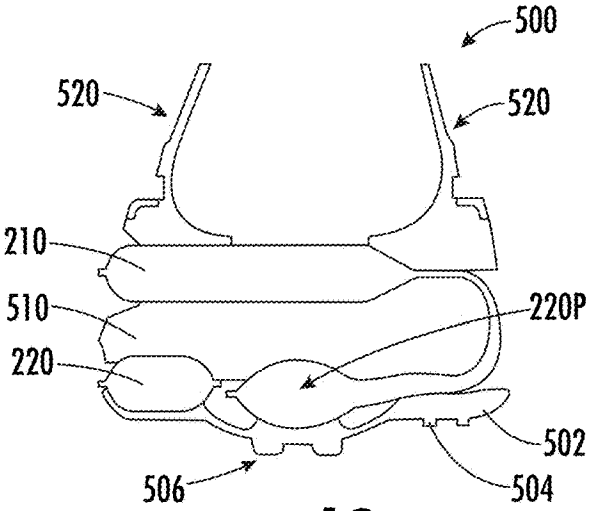
Figure 1N:
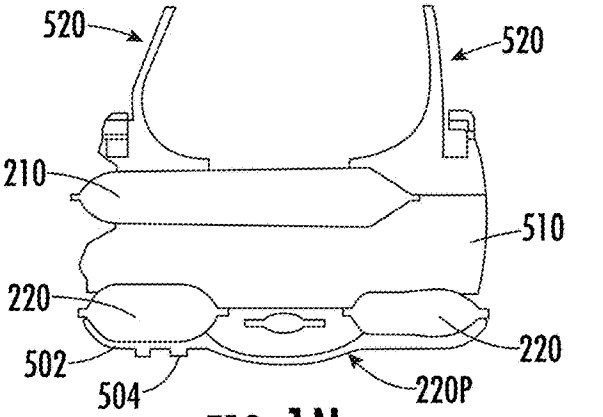
Figure 1P:
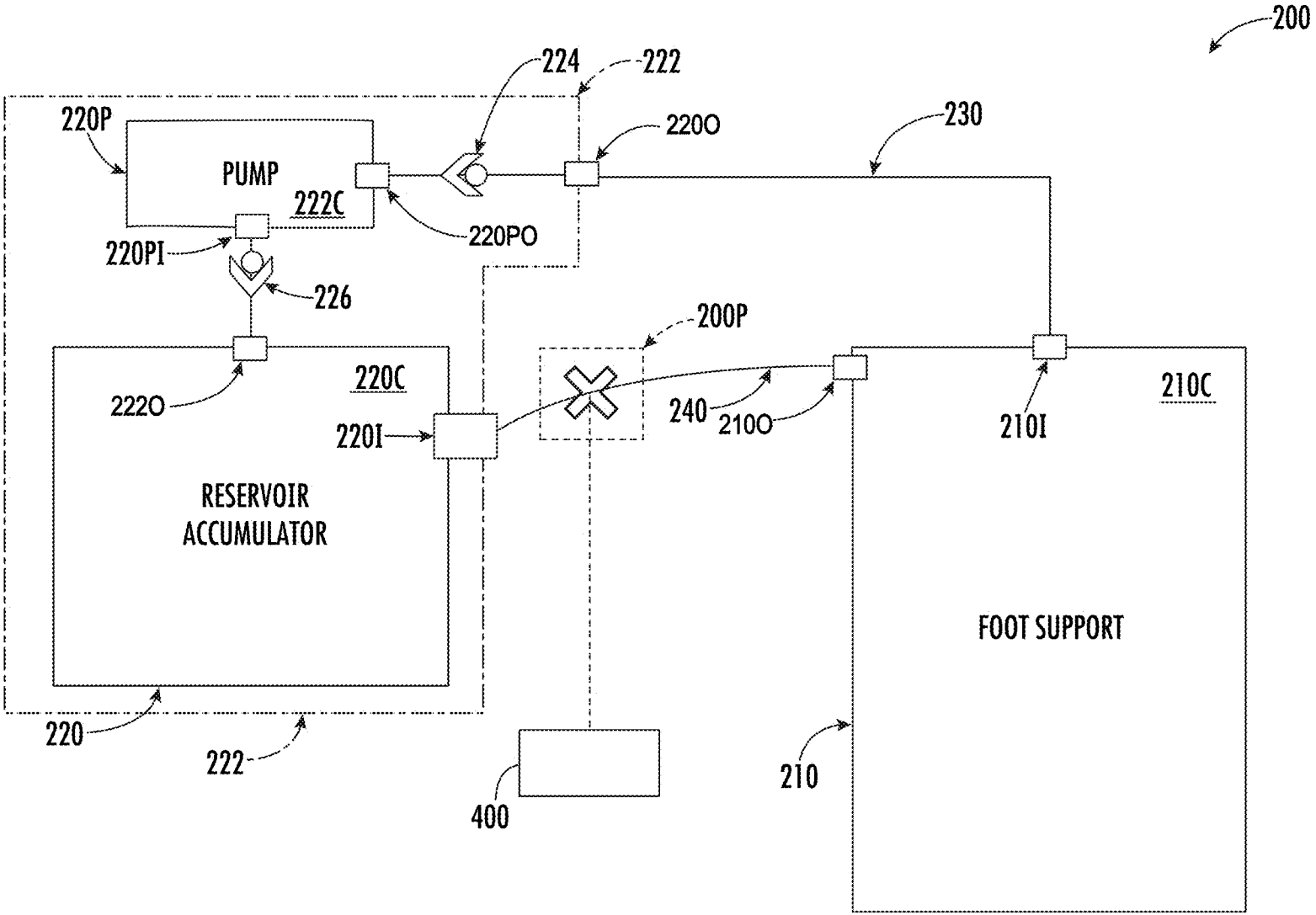

Example bladder systems 200, sole structures 500 (or other foot support systems), articles of footwear 100 (or other foot-receiving devices), and/or components thereof in accordance with aspects of this technology now will be described in conjunction with FIGS. 1A-7B. FIG. 1A provides a top view of a sole structure 500 in accordance with at least some examples of this technology; FIG. 1B provides a bottom view of the sole structure 500; FIG. 1C provides a front view of the sole structure 500; FIG. 1D provides a rear view of the sole structure 500; FIG. 1E provides a lateral side view of the sole structure 500 and article of footwear 100 with switch member 400 in the downward position; FIG. 1F provides a medial side view of the sole structure 500 and article of footwear 100 with the switch member 400 in the downward position; FIG. 1G provides a lateral side view of the sole structure 500 with the switch member 400 in the upward position; FIG. 1H provides a medial side view of the sole structure 500 with the switch member 400 in the upward position; FIG. 1I provides a cross sectional view taken along line 1I-1I in FIG. 1A with the switch member 400 in the downward position; FIG. 1J provides a provides a cross sectional view taken along line 1I-1I in FIG. 1A with the switch member 400 in the upward position; FIG. 1K provides a cross sectional view taken along line 1K-1K in FIG. 1A; FIG. 1L provides a cross sectional view taken along line 1L-1L in FIG. 1A; FIG. 1M provides a cross sectional view taken along line 1M-1M in FIG. 1A; FIG. 1N provides a cross sectional view taken along line 1N-1N in FIG. 1A; FIG. 1O provides a cross sectional view taken along line 1O-1O in FIG. 1A; FIG. 1P schematically illustrates features of movement of fluid within fluid system 200, sole structure 500, and article of footwear 100 in accordance with some examples of this technology; and FIG. 1Q provides a rear lateral perspective view of an example article of footwear 100 in accordance with some examples of this technology.

The example article of footwear 100 includes an upper 102 (e.g., partially shown in FIGS. 1E, 1F, and 1Q) and a sole structure 500 engaged with the upper 102. Only a portion of the upper 102 is shown in FIGS. 1E, 1F, and 1Q, but the upper 102 may include any desired materials (e.g. fabrics, leathers, plastics, etc.), components, number of components, constructions, structures, etc., without departing from this technology, including conventional materials, components, numbers of components, constructions, structures, etc., as are known and used in the footwear art. The upper 102 may be engaged with the sole structure 500 in any desired manner, including through the use of one or more of adhesives, stitching, or mechanical fasteners, including in manners conventionally known and used in the footwear arts.

The sole structure 500 and/or article of footwear 100 of this example includes: (a) at least a portion of a bladder system 200 (e.g., at least foot support bladder portion 210), (b) an outsole 502, and (c) a midsole 510. These and other parts will be described in more detail below. In general, fluid is moved between a foot support bladder portion 210 and a fluid reservoir portion 220 of bladder system 200 to change the foot support pressure (e.g., hardness) of the foot support bladder portion 210. A pump (e.g., foot activated pump 220P or another type of pump or compressor) and fluid lines 230, 240 move fluid between these bladder system 200 components (i.e., between foot support bladder portion 210 and fluid reservoir portion 220).

Figure 1Q:
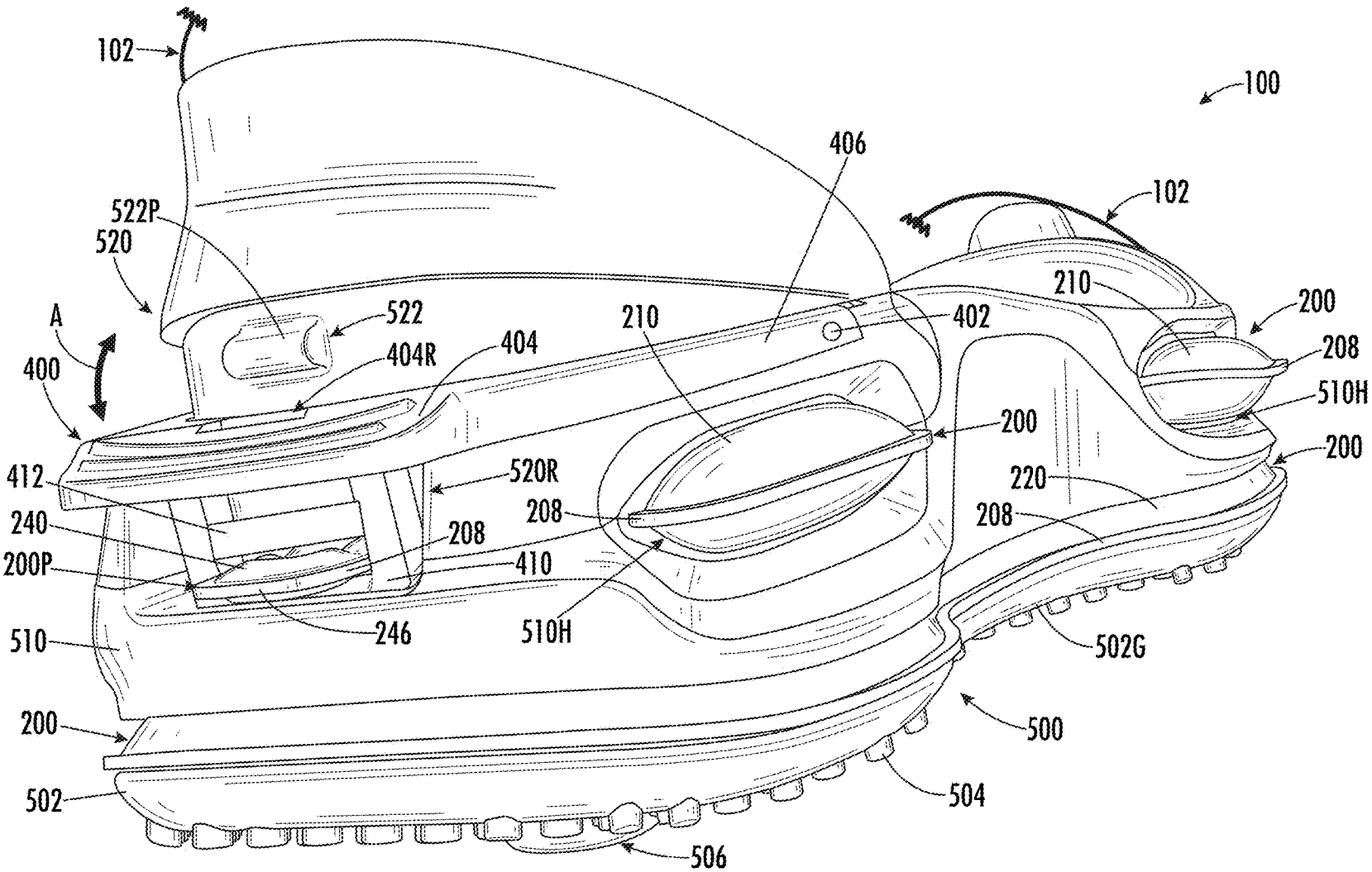

In the example sole structure 500 of FIGS. 1A-1O and 1Q, a portion of the bladder system 200 (e.g., the fluid reservoir portion 220) is located between the midsole 510 and outsole 502. Also, while not a requirement, in this illustrated example article of footwear 100 and sole structure 500, a portion of the bladder system 200 (e.g., the fluid reservoir portion 220) is exposed between the midsole 510 and outsole 502. Bladder system 200 may be formed from two (or more) thermoplastic elastomer layers (e.g., sheets or portions of a sheet) that are sealed together at one or more seams 208 as will be described in more detail below. The bladder systems 200 can be formed from such thermoplastic elastomer material layers (e.g., thermoplastic polyurethane materials or "TPUs") in conventional manners using conventional techniques, e.g., as are known and used in the footwear arts (such as welding techniques, bonding with adhesives, etc.).

Article of footwear 100 of this example further includes a heel component 520, e.g., engaged with the midsole 510, with another portion of the sole structure 500, and/or with the upper 102. Heel component 520 may be made from a rigid material, such as a plastic material and/or materials of the types used in conventional heel counter structures. Heel component 520 of this illustrated example provides a base for pivotally engaging a switch member 400, e.g., at pivot supports 402 or anchor points provided on the lateral side and the medial side of this example sole structure 500 and article of footwear 100. The switch member 400 of FIGS. 1A-1O and 1Q pivots on pivot support(s) 402 between the downward position shown in FIGS. 1E, 1F, 1I, and 1Q and an upward position shown in FIGS. 1G, 1H, and 1J. The rear view of FIG. 1D depicts switch member 400 in both the downward position (solid lines) and the upward position (broken lines) to illustrate the extent of motion of this example switch member 400. In the upward position, the base 404 of switch member 400 is moved upward to engage and secure to latch member 522 provided as part of the heel component 520 (to hold the switch member 400 in place with respect to the heel component 520). While FIG. 1A shows the base 404 of switch member 400 having a recess 404R that extends over and past the projection 522P provided as part of the latch member 522, other latching structural components may be provided in other specific examples of this aspect of the present technology (e.g., where switch member 400 includes a projection that fits into a recess provided in heel component 520, where the arms 406 of the switch member 400 (e.g., lateral arm and medial arm extending from the base 404R) engage a latch, etc.).

In the sole structure 500 and article of footwear 100 described above and shown in FIGS. 1A-1O and 1Q, at least one of the heel component 520 and/or the midsole 510 defines a recess 520R or opening. Recess 520R of this example provides space to accommodate a fluid line portion 200P of bladder system 200 and a portion of the switch member 400. As shown by a comparison of FIGS. 11 and 1J (and as will be described in more detail below), switch member 400 is used to switch the fluid line portion 200P of the bladder system 200 between an open configuration (e.g., with the switch member 400 in the downward position as shown in FIG. 1I) and a closed configuration (with the switch member 400 in the upward and latched position as shown in FIG. 1J).

U.S. Provisional Patent Appln. No. 63/604,566 entitled "Bladder Systems with Closable Fluid Line and Foot Supports Including Such Bladder Systems" provides additional structural details of bladder systems 200 that may be used in accordance with aspects of the technology disclosed herein. Additionally or alternatively, the bladder system 200, upper 102, outsole 502, midsole 510, and/or article of footwear 100 may be formed from component parts and/or have constructions of the types described and illustrated in U.S. Pat. No. 11,206,896 B2, U.S. Pat. No. 11,234,485 B2, U.S. Provisional Patent Appln. No. 63/477,719, U.S. Provisional Patent Appln. No. 63/498,593, and/or U.S. Provisional Patent Appln. No. 63/541,431.

Figure 2A:
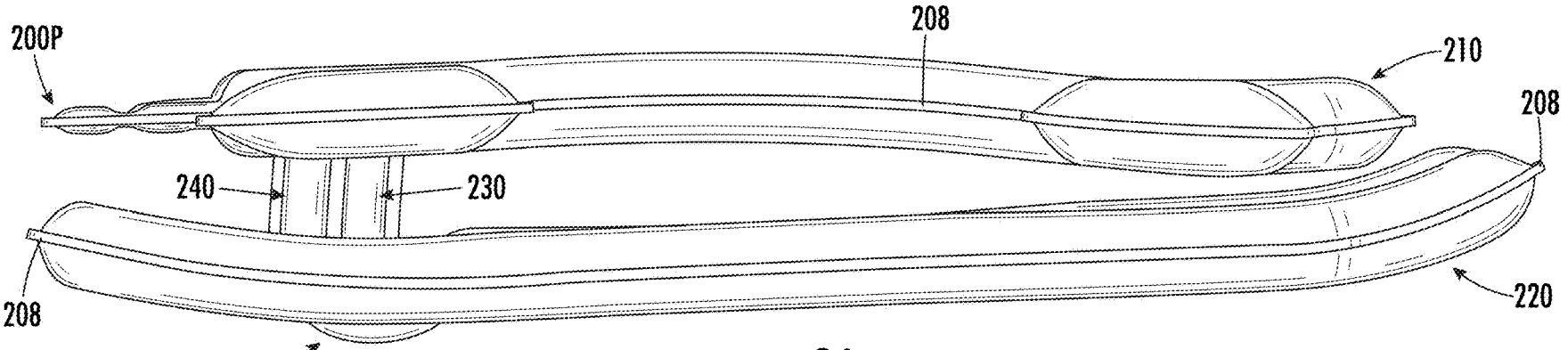
FIGS. 2A-2H provide various views of bladder systems in accordance with some examples and aspects of this technology.
Figure 2B:
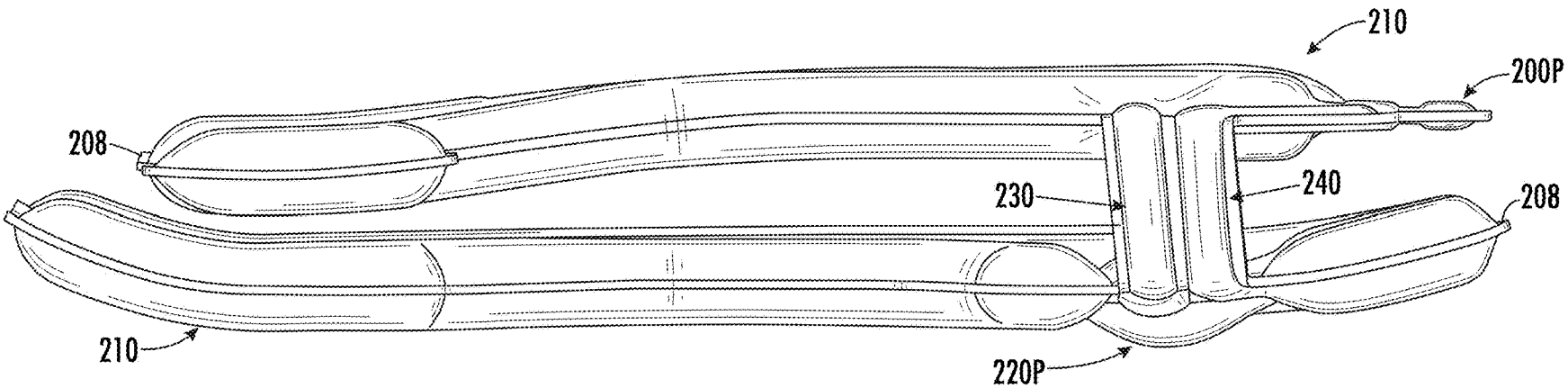
Figure 2C:
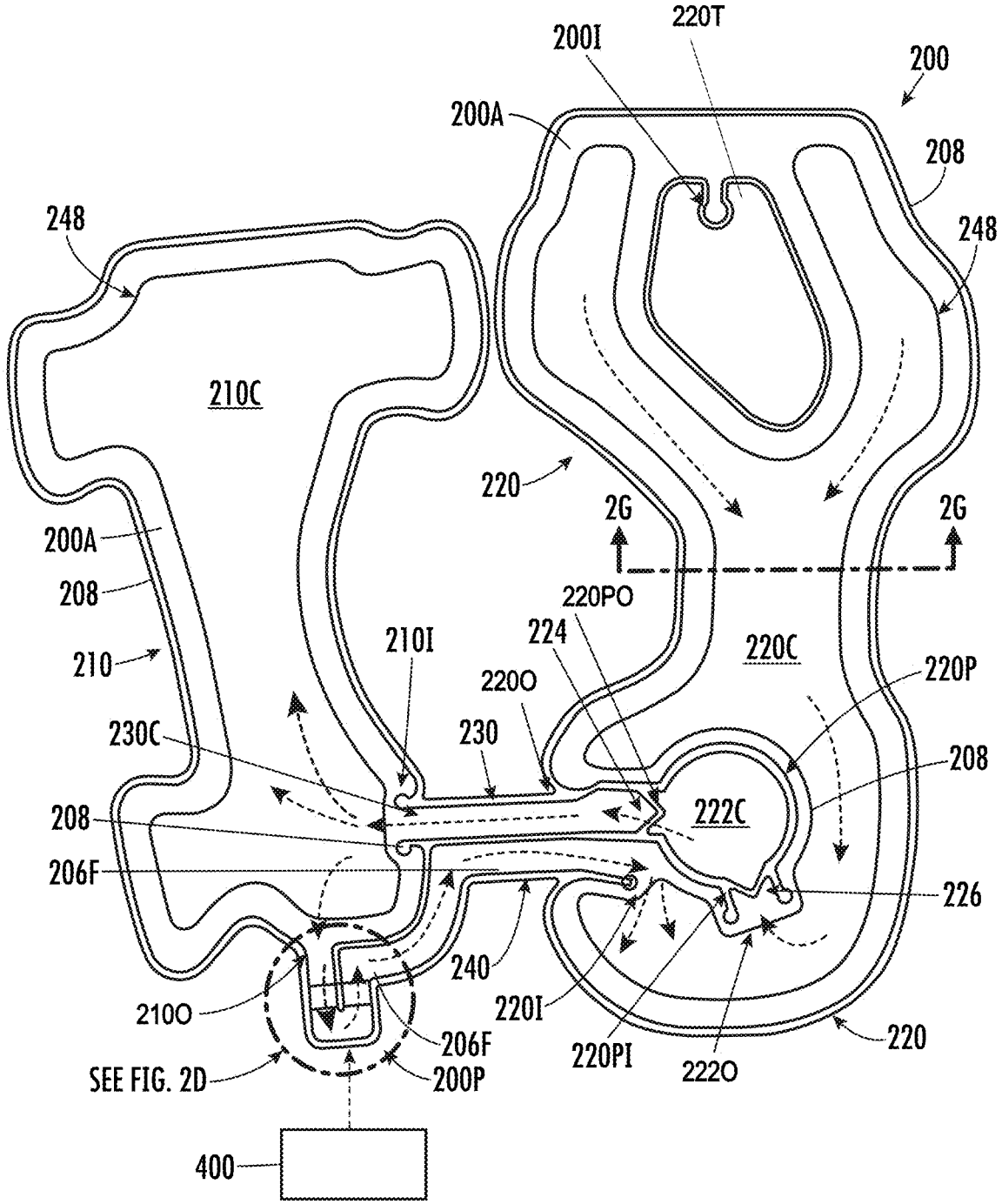
Figure 2D:
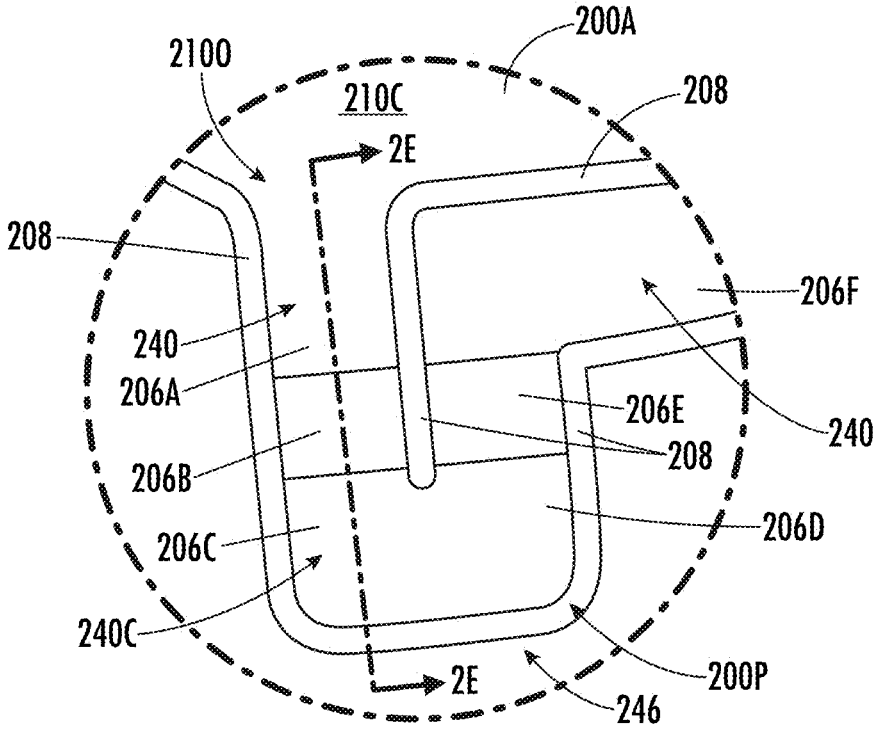
Figure 2E:
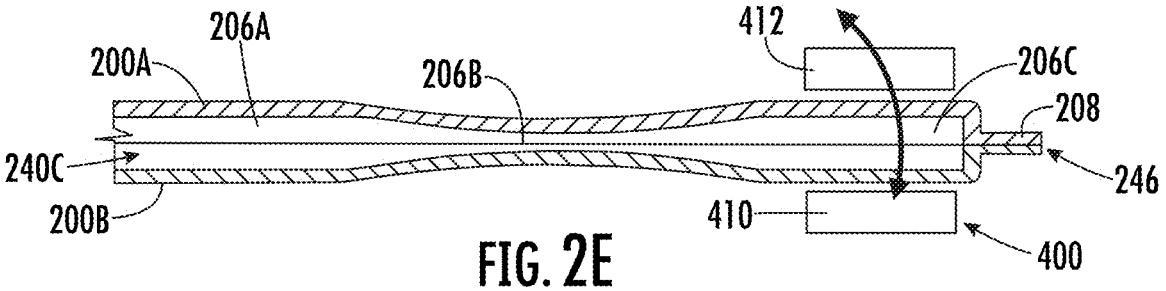
Figure 2F:
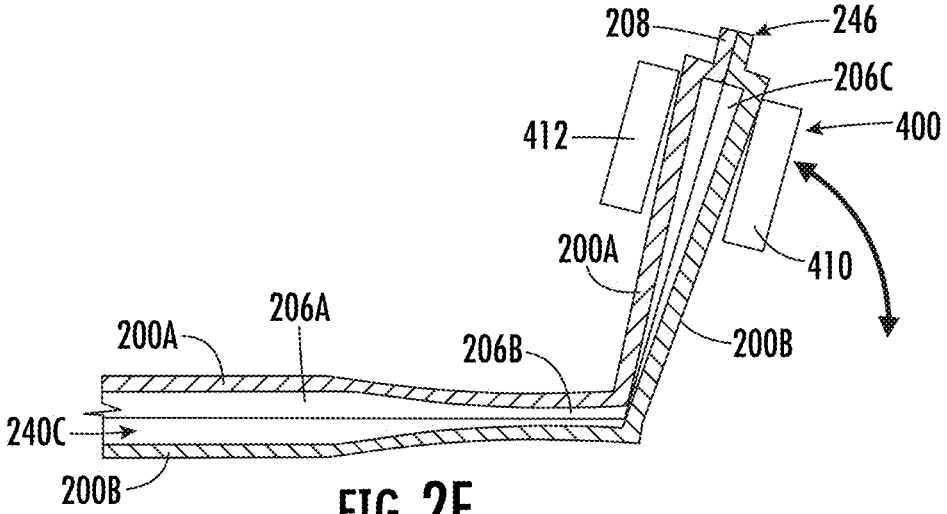
Figure 2G:
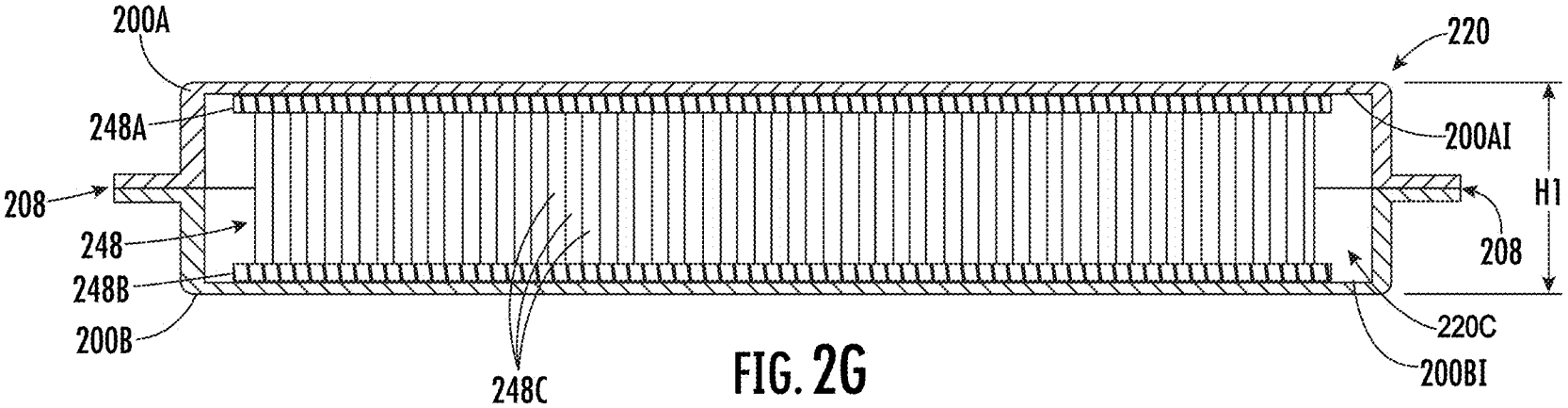
Figure 2H:
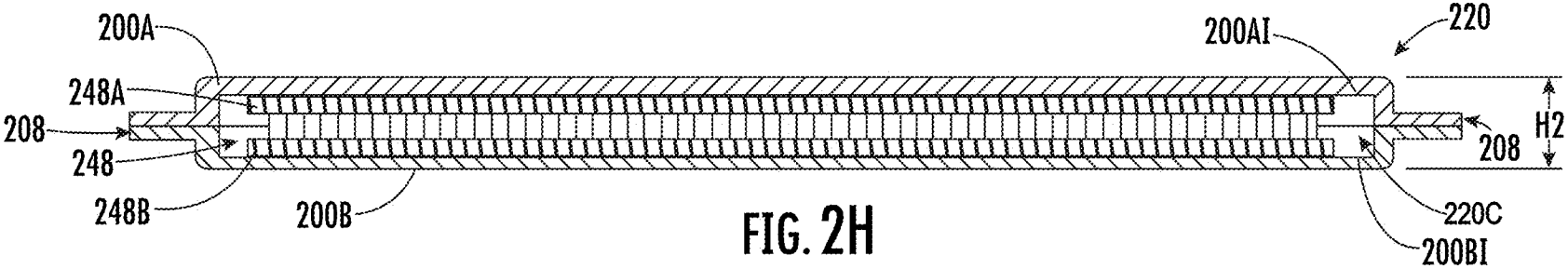

Aspects of this example bladder system 200 now will be described in more detail in conjunction with FIGS. 1P and 2A-2H. FIG. 1P schematically illustrates features of a bladder system 200 that may be included in foot support systems, sole structures 500, and/or articles of footwear 100 in accordance with some aspects of this technology. FIGS. 2A and 2B show a lateral side view and a medial side view, respectively, of a bladder system 200 orientated to fit into a sole structure 500 and article of footwear 100 in accordance with at least some aspects of this technology. FIG. 2C shows a top plan view of an example bladder system 200 prior to being incorporated into a sole structure 500 or article of footwear 100; FIG. 2D shows an enlarged view of the fluid line portion 200P shown encircled in FIG. 2C (the "flap"); FIG. 2E shows a cross sectional view of fluid line portion 200P taken along line 2E-2E in FIG. 2D in an open configuration; FIG. 2F shows a cross sectional view of fluid line portion 200P in a closed configuration; FIG. 2G shows a cross sectional view of fluid reservoir portion 220 taken along line 2G-2G in FIG. 2C with the bladder system 200 in a lower pressure foot support configuration (e.g., in which this example fluid reservoir portion 220 and foot support bladder portion 210 are at an "equalized" pressure); and FIG. 2H shows a cross sectional view of fluid reservoir portion 220 taken along line 2G-2G in FIG. 2C with the bladder system 200 in a higher pressure foot support configuration (e.g., in which fluid is moved out of this example fluid reservoir portion 220 and into foot support bladder portion 210). Where the same reference numbers are used in FIGS. 1P-2H as used in FIGS. 1A-1O and 1Q, the same or similar parts are being referenced, and much of the overlapping description may be omitted.

First, the various portions of this example bladder system 200 will be described in conjunction with FIGS. 1A-2C. This example bladder system 200 includes four main regions or portions as follows: (a) a foot support bladder portion 210 (or chamber); (b) a fluid reservoir portion 220 (or chamber); (c) a first fluid line 230 (including its interior fluid channel 230C), e.g., for moving fluid from the fluid reservoir portion 220 to the foot support bladder portion 210; and (d) a second fluid line 240 (including its interior fluid channel 240C), e.g., for moving fluid from the foot support bladder portion 210 to the fluid reservoir portion 220. As further shown in these figures, this example bladder system 200 includes a pump 220P (e.g., a foot-activated pump, such as a bulb-type pump located in a heel support region of the bladder system 200) for moving fluid from the fluid reservoir portion 220 to the fluid line 230. The broken line arrows in FIG. 2C illustrate the direction of fluid flow in this example bladder system 200.

In the example of FIGS. 2A-2C, the pump 220P is formed within and/or as part of the fluid reservoir portion 220 of the bladder system 200 (and the pump 220P region may be at least partially surrounded by the fluid reservoir portion 220, as shown in FIG. 2C). These combined components are shown contained in dot-dash box 222 in FIG. 1P. In some examples of this technology, however: (a) the pump 220P need not be included as part of the fluid reservoir portion 220, (b) the pump 220P need not be a foot-activated pump and/or a bulb-type pump (e.g., it could be formed as a separate component connected by fluid lines, etc.), and/or (c) the pump 220P need not be included in the heel support region (e.g., a foot-activated pump could be in a forefoot support region of a sole structure 500). Also, two or more foot activated pumps could be provided (e.g., connected in series), e.g., of the types described in U.S. Pat. No. 11,510,458 B2, which patent is entirely incorporated herein by reference.

Various sizes, shapes, and/or arrangements of foot support bladder portions 210 and fluid reservoir portions 220 may be used in specific examples of this technology. As illustrated in FIGS. 2A-2C, the foot support bladder portion 210 may include a heel support region, a midfoot support region, and a forefoot support region, e.g., for supporting at least portions of the plantar surface of a wearer's heel, midfoot, and forefoot. Additionally or alternatively, the fluid reservoir portion 220 may include a heel region, a midfoot region, and a forefoot region, e.g., underlying at least portions of the plantar surface of a wearer's heel, midfoot, and forefoot. When mounted in a sole structure 500 and/or article of footwear 100 as shown in FIGS. 2A-2B, the foot support bladder portion 210 and fluid reservoir portion 220 may be moved with respect to one another from the configuration shown in FIG. 2C so that fluid lines 230, 240 curve in a vertical direction and the two major faces of foot support bladder portion 210 and fluid reservoir portion 220 shown in FIG. 2C directly face one another (optionally with a foam material of midsole component 510 or other material located between at least some portions of these facing major surfaces).

In some examples of this technology, as shown in FIGS. 2A-2C (and others), a portion 200P of fluid line 240 extends outward (e.g., rearward) from a heel portion (e.g., a rear heel portion) of the foot support bladder portion 210. This portion 200P of fluid line 240 may form a flap through which the portion 200P of fluid line 240 extends. This portion 200P may form part of and continue from the seam 208 joining the thermoplastic elastomer layers forming the bladder system 200. As shown in FIGS. 1D, 1F, 1I, 1J, and 1Q, the flap including fluid line portion 200P of fluid line 240 may be at least partially exposed at the exterior of the sole structure 500 and/or article of footwear 100 structure (thus forming an "exposed flap").

In the configuration shown in FIGS. 1E, 1F, 1I, and 1Q, the switch member 400 is in the open configuration, which corresponds to the "lower pressure foot support configuration" that will be described in more detail below. In the configuration shown in FIGS. 1G, 1H, and 1J, the switch member 400 is in the closed configuration, which corresponds to the "higher pressure foot support configuration" that will be described in more detail below. Additionally, this example bladder system 200 is a "closed system," e.g., the bladder system 200 has a fixed amount (e.g., mass) of fluid (e.g., gas, such as air or other gas, including gases conventionally known and used in foot support bladder systems) sealed within it, and the bladder system 200 does not bring in new fluid from the external environment and does not discharge fluid into the external environment. Fluid moves between the foot support bladder portion 210 and fluid reservoir portion 220 to change the foot support pressure in the foot support bladder portion 210. Alternatively, however, at least some aspects of this technology may be used in "open" bladder systems, e.g., bladder systems that bring in air (or other gas) from the external environment (e.g., via a pump (a manual pump (including a foot-activated pump or an electric pump) or compressor) and/or discharge air (or other gas) into the external environment to change foot support pressure in a foot support bladder.

Turning to FIG. 1P along with FIGS. 2A-2C, when switch member 400 is open (in the downward position in this example), fluid line 240 is open, and fluid freely flows around the entire bladder system 200 circuit as follows: (a) from foot-activated pump 220P, (b) through pump outlet 220PO, (c) through check valve 224, (d) through fluid reservoir outlet 220O (if separate from the check valve 224), (e) into first fluid line 230, (f) through foot support bladder inlet 210I, (g) into foot support bladder portion 210 (into its interior chamber 210C), (h) through foot support bladder outlet 210O, (i) into second fluid line 240, (j) through fluid reservoir inlet 220I, (k) into fluid reservoir portion 220 (into its interior chamber 220C), (l) through fluid reservoir outlet 222O, (m) through check valve 226, (n) through pump inlet 220PI, and (o) back into pump 220P (e.g., into its interior chamber 222C). In use, check valve 226 (or other valve structure) prevents pumped fluid (e.g., from compression of bulb pump 220P) from re-entering the main reservoir volume of the fluid reservoir portion 220 via fluid reservoir outlet 222O, and check valve 224 (or other valve structure) prevents fluid from re-entering the pump 220P from the foot support bladder portion 210 (via fluid reservoir outlet 220O). After a step and compression of the foot-activated pump 220P's interior chamber 222C to expel fluid from the pump outlet 220PO, the interior chamber 222C of the pump 220P will re-expand and be refilled with fluid moving from the fluid reservoir portion 220 through check valve 226 for the next step and pump cycle.

When switch member 400 is closed, however (in the upward position in this example), fluid line 240 is closed and fluid flow around the circuit is disrupted. In that configuration—the "higher pressure foot support configuration"—fluid moves as follows: (a) from foot-activated pump 220P, (b) through pump outlet 220PO, (c) through check valve 224, (d) through fluid reservoir outlet 220O (if separate from the check valve 224), (e) into first fluid line 230, (f) through foot support bladder inlet 210I, and (g) into foot support bladder portion 210 (into its interior chamber 210C). After a step and compression of the foot-activated pump 220P's interior chamber 222C to expel fluid from the pump outlet 220PO, the interior chamber 222C of the pump 220P will re-expand and be refilled with fluid moving from the fluid reservoir portion 220 through check valve 226 for the next step and pump cycle (e.g., as long as fluid remains in the reservoir portion 220). Because fluid line 240 is closed and check valve 224 prevents fluid from backflowing into the pump 220P via pump outlet 220PO, fluid accumulates in the foot support bladder portion 210 (e.g., incrementally increasing gas mass and pressure in a step-by-step manner) and fluid becomes depleted in the fluid reservoir portion 220. This action increases fluid pressure in the foot support bladder portion 210 and decreases fluid pressure in the fluid reservoir portion 220.

The foot support bladder portion 210, when fully inflated, will define a first interior volume V1 (volume of interior chamber 210C) and the fluid reservoir portion 220, when fully inflated, will define a second interior volume V2 (volume of interior chamber 220C). These volumes may vary with respect to one another. In some examples of this technology, these volumes will satisfy at least one of the following relationships: $0.8\times V2 \leq V1 \leq 1.2\times V2$; and/or $0.9\times V2 \leq V1 \leq 1.1\times V2$. In some examples of this technology, V1 and V2 may be substantially equal (e.g., within ±2% of one another).

Additional aspects of this example bladder system 200 will be described below with additional reference to FIGS. 2D-2H. The bladder system 200 shown in FIGS. 2A-2C includes a first thermoplastic elastomer layer 200A joined to a second thermoplastic elastomer layer 200B at one or more seams 208 to form an interior fluid chamber (e.g., a continuous interior chamber) that includes: (a) the interior chamber 210C of foot support bladder portion 210; (b) the interior chamber 220C of the fluid reservoir portion 220; (c) the interior fluid channel 230C of first fluid line 230 (extending between the fluid reservoir portion 220 and the foot support bladder portion 210); (d) the interior fluid channel 240C of second fluid line 240 (extending between the foot support bladder portion 210 and the fluid reservoir portion 220); and (e) in at least some examples, the interior chamber 222C of pump 220P.

In at least some examples of this technology, all of these interior fluid chamber portions (e.g., the interior chamber 210C of foot support bladder portion 210, the interior chamber 220C of the fluid reservoir portion 220, the interior fluid channel of fluid line 230, the interior fluid channel 240C of fluid line 240, and (in at least some examples) the interior chamber 222C of pump 220P) may be formed as a single, unitary bladder component (e.g., formed from two thermoplastic elastomer layers 200A, 200B provided as part of one or more sheets of thermoplastic elastomer material). In such unitary bladder component structures, the fluid lines 230 and 240 are integrally formed with the foot support bladder portion 210 and the fluid reservoir portion 220. Thus, in production of such bladder systems 200, there is no need to fix separate fluid lines (e.g., tubing) to bladder ports (e.g., by welding, by adhesives, etc.) and there is no need to provide and incorporate any separate port hardware into the bladder structure. Such unitary constructions can simplify production, avoid use of adhesives, reduce costs, and/or help avoid formation of leaks. If needed, however, hardware for the valves 224 and/or 226 may be placed between the thermoplastic elastomer layers 200A and 200B prior to seam 208 formation and/or at another appropriate time in the production process and/or the valves 224 and/or 226 may be provided in another appropriate manner.

As shown in FIGS. 1D-1F, 1I, 1J, 1Q, and 2A-2D, a portion 200P of the fluid line 240 extends outward (e.g., rearward) from a heel portion (e.g., a rear heel portion) of the foot support bladder portion 210 and forms a flap (e.g., an exposed flap) through which the interior fluid channel 240C of fluid line 240 extends. This flap may extend from and form part of the seam 208 between thermoplastic elastomer layers 200A, 200B. Additional example features and properties of this fluid line portion 200P and flap now will be described.

First thermoplastic elastomer layer 200A and second thermoplastic elastomer layer 200B (formed from one or more sheets of thermoplastic elastomer material) are joined together (e.g., at one or more seams 208) to define an interior bladder chamber (e.g., including foot support bladder interior chamber 210C in this illustrated example). See FIGS. 2E and 2F. Fluid line 240 has a first end opening into and in fluid communication with the foot support bladder interior chamber 210C. The portion 200P of the fluid line 240 exiting the foot support bladder interior chamber 210C at foot support bladder outlet 210O (e.g., into the flap) includes: (i) a first fluid line region 206A having a first transverse cross sectional area (e.g., extending in a direction away from the foot support bladder interior chamber 210C), (ii) a second fluid line region 206B extending from the first fluid line region 206A (e.g., in the direction away from the foot support bladder interior chamber 210C), the second fluid line region 206B having a second transverse cross sectional area that is smaller than the first transverse cross sectional area, and (iii) a third fluid line region 206C extending from the second fluid line region 206B (e.g., in the direction away from the foot support bladder interior chamber 210C), the third fluid line region 206C having a third transverse cross sectional area that is greater than the second transverse cross sectional area (and optionally the same or substantially the same as the first transverse cross sectional area). Thus, the flap may include: (a) a forward portion (e.g., first fluid line region 206A) where a first end of fluid line 240 opens into and receives fluid from the foot support bladder chamber 210 (or, in other examples, from the fluid reservoir chamber 220) and (b) a rearward portion forming a free end 246 or edge of the flap.

In some examples of this technology, this portion 200P of the fluid line 240 (e.g., in the flap) may further include: (i) a fourth fluid line region 206D extending from the third fluid line region 206C (e.g., in a direction toward the foot support bladder interior chamber 210C), the fourth fluid line region 206D having a fourth transverse cross sectional area (which may be the same or substantially the same as the first and/or third cross transverse sectional areas and/or may be greater than the second transverse cross sectional area), and (ii) a fifth fluid line region 206E extending from the fourth fluid line region 206D (e.g., in the direction toward the foot support bladder interior chamber 210C), the fifth fluid line region 206E having a fifth transverse cross sectional area that is smaller than the fourth transverse cross sectional area (and which may be the same or substantially the same as the second transverse cross sectional area). This portion of the fluid line 240 (e.g., in the flap) further may include at least a portion of a sixth fluid line region 206F extending from the fifth fluid line region 206E, the sixth fluid line region 206F having a sixth transverse cross sectional area that is greater than the fifth transverse cross sectional area (and which may be the same or substantially the same as one or more of the first, third, and/or fourth transverse cross sectional areas).

"Transverse cross sectional area," as that term is used herein in this context, means an area enclosed by a fluid line and oriented in a direction perpendicular to the direction of fluid flow. The term "substantially the same" as used herein in this context means that the two areas being compared are within 10% of one another (e.g., A1=A2±10% and/or A2=A1±10%). In at least some examples of this technology, each of the first transverse cross sectional area, the second transverse cross sectional area, the third transverse cross sectional area, the fourth transverse cross sectional area (if present), and the fifth transverse cross sectional area (if present) may be less than 500 $mm^2$. The second transverse cross sectional area and/or the fifth transverse cross sectional area (if present) may be at least 10% smaller than the area(s) of one or more of the first transverse cross sectional area, the third transverse cross sectional area, and/or the fourth transverse cross sectional area (if present), and in some examples, at least 15% smaller, at least 20% smaller, at least 25% smaller, or even at least 30% smaller. Thus, the portion 200P of the fluid line 240 included in the flap may include an open interior fluid channel 240C within the flap, the open interior fluid channel 240C having: (a) a first arm (e.g., formed from first fluid line region 206A, second fluid line region 206B, and at least a portion of third fluid line region 206C), (b) a second arm (e.g., formed from at least a portion of the fourth fluid line region 206D, fifth fluid line region 206E, and at least a portion of sixth fluid line region 206F, if present), and (c) a base connecting the first arm and the second arm (e.g., where the base includes at least a portion of the third fluid line region 206C and/or the fourth fluid line region 206D). In this manner, the first arm will define a first thinned region of the open interior fluid channel 240C (e.g., corresponding to second fluid line region 206B) and the second arm will define a second thinned region of the open interior fluid channel 240C (e.g., corresponding to fifth fluid line region 206E). These thinned regions may be located adjacent one another (e.g., side-by-side) and may form a pre-crease or pre-bend region of fluid line 240 in the flap.

The second fluid line region 206B may be located adjacent the fifth fluid line region 206E (e.g., side-by-side), and optionally separated therefrom by a portion of a seam 208. Thus, a portion of a seam 208 may define adjacent sides of each of the second fluid line region 206B and the fifth fluid line region 206E. Additionally or alternatively, the first fluid line region 206A may be located adjacent the sixth fluid line region 206F, and optionally separated therefrom by a portion of a seam 208. Thus, a portion of a seam 208 (e.g., the same seam 208 mentioned above) may define adjacent sides of the first fluid line region 206A and the sixth fluid line region 206F. Similarly, if desired, the third fluid line region 206C may be located adjacent the fourth fluid line region 206D, and optionally separated therefrom by a portion of that same seam 208. Thus, a portion of this seam 208 may define adjacent sides of the third fluid line region 206C and the fourth fluid line region 206D.

In some examples of this technology, a linear fluid line length of fluid line 240 within the flap (e.g., from a beginning of the first fluid line region 206A (at the outlet 210O of the foot support bladder portion 210) at least through an end of the fifth fluid line region 206E) may be less than 100 mm long, and in some examples, less than 90 mm, less than 75 mm, less than 65 mm, or even less than 50 mm long. Also, in the example structure shown in FIG. 2D, the portion 200P of the fluid line 240 included within the flap (e.g., at least a portion of the first fluid line region 206A, the second fluid line region 206B, the third fluid line region 206C, the fourth fluid line region 206D, and/or the fifth fluid line region 206E) may form a square or rectangular shaped tab or flap that extends outward from the first interior bladder chamber (e.g., the foot support bladder interior chamber 210C). Additionally or alternatively, in at least some examples of this technology, the interior channel 240C forming the fluid line through the flap area (e.g., including two or more of the fluid line regions 206A-206F described above) may form a U-shaped channel.

The sixth fluid line region 206F may extend to and/or otherwise be in fluid communication with the interior chamber of another bladder portion, e.g., the interior chamber 220C of the fluid reservoir portion 220 in the illustrated example of FIGS. 2A-2H. Thus, as shown in FIG. 2C, the sixth fluid line region 206F may extend from a medial heel region of the fluid reservoir portion 220 to the portion 200P of fluid line 240 included in the flap. At least a portion of the sixth fluid line region 206F of fluid line 240 may lie adjacent and extend along (e.g., in parallel with) at least a portion of fluid line 230 (and optionally is separated therefrom by a segment of a seam 208). These adjacent portions of the sixth fluid line region 206F and fluid line 230 may be located in a heel region and/or a midfoot region (e.g. medial heel and/or medial midfoot region(s)) of the bladder system 200, sole structure 500, and article of footwear 100. Additionally or alternatively, these adjacent portions of the sixth fluid line region 206F and fluid line 230 may form a bend region of bladder system 200, e.g., to support movement (e.g., rotation) of the foot support bladder portion 210 with respect to the fluid reservoir portion 220 (e.g., so that the foot support bladder portion 210 overlies the fluid reservoir portion 220 in the final assembled sole structure 500 and article of footwear 100 as shown in FIGS. 1A-1O, 1Q, 2A, and 2B). If necessary or desired, structures of the types described in one or more of U.S. Pat. No. 11,206,896 B2, U.S. Pat. No. 11,234,485 B2, U.S. Provisional Patent Appln. No. 63/477,719, U.S. Provisional Patent Appln. No. 63/498,593, and U.S. Provisional Patent Appln. No. 63/541,431 may be provided to support the fluid lines 230, 240 and/or to prevent undesired pinching or closure of the fluid lines 230, 240 at these adjacent portions of the sixth fluid line region 206F and fluid line 230. Additionally or alternatively, as shown in FIGS. 3B-4D and described in more detail below, the outsole 502 and/or midsole 510 may include structures for supporting fluid line(s) 230, 240.

In at least some examples of this technology, the second fluid line region 206B and/or the fifth fluid line region 206E (when present)—the region(s) having the smaller transverse cross sectional area(s)—may form a pre-crease or pre-bend region for closing the fluid line 240. As shown in FIGS. 1I, 1J, 1Q, 2E, and 2F (and others), switch member 400 may include a contact surface 410, e.g., located beneath the flap that includes portion 200P of fluid line 240. When the switch member 400 is moved upward, contact surface 410 will contact the intermediate portion of the flap (between its origin at the foot support bladder portion 210 and its free end 246) and pull the free end 246 of the fluid line portion 200P upward, as shown in the transition from FIG. 1I to FIGS. 1J and in the transition from FIG. 2E to FIG. 2F. This action pinches interior fluid channel 240C closed, thereby changing the fluid line 240 from an open configuration to a closed configuration and thereby stopping fluid flow through fluid line 240. This action changes the bladder system 200 from the lower pressure foot support configuration shown in FIGS. 1E, 1F, 1I, 1Q, and 2E to the higher pressure foot support configuration shown in FIGS. 1G, 1H, 1J, and 2F. If necessary or desired, the switch member 400 may include another contact surface 412, this one located above the flap that includes portion 200P of fluid line 240 (see the broken lines in FIGS. 1D and 7A). The flap portion 200P of the fluid line 240 may extend between contact surfaces 410 and 412. This additional contact surface 412, when present, can help push the free end 246 of the flap back downward (and help assure that the interior fluid channel 240C opens back up) when switch member 400 is moved back to the downward position.

The flap through which the portion 200P of fluid line 240 extends may have a relatively small size and/or volume, e.g., compared to the sizes and/or volumes of the foot support bladder portion 210's interior chamber 210C and/or the fluid reservoir portion 220's interior chamber 220C. As some more specific examples, the flap (e.g., the portion 200P including at least the first fluid line region 206A, the second fluid line region 206B, and the third fluid line region 206C described above) may define an area of less than 2000 $mm^2$ (and in some examples, an area of less than 1600 $mm^2$, less than 1200 $mm^2$, and even less than 1000 $mm^2$). As some additional examples, the fluid line 240 within the flap (e.g., the portion 200P including at least the first fluid line region 206A, the second fluid line region 206B, the third fluid line region 206C, the fourth fluid line region 206D, and the fifth fluid line region 206E described above) may be sized within any of the area ranges described above. Additionally or alternatively, the flap (including the portion of the fluid line 240 within it) may have a thickness of less than 20 mm (and in some examples, of less than 16 mm, less than 12 mm, or even less than 10 mm) through at least 75% of the flap's surface area. These thickness size ranges may be present through at least 80%, at least 85%, at least 90%, at least 95%, or even over 100% of the flap surface area. Still additionally or alternatively, the interior fluid channel 240C of the fluid line 240 extending through the flap (e.g., from a beginning of the first fluid line region 206A (at the outlet 210O of the foot support bladder portion 210) through an end of the fifth fluid line region 206E) may enclose a volume of less than 7500 $mm^3$, and in some examples, less than 6000 $mm^3$, less than 5000 $mm^3$, or even less than 4000 $mm^3$. Still additionally or alternatively, the interior fluid channel 240C of the fluid line 240 through the flap (e.g., from a beginning of the first fluid line region 206A (at the outlet 210O of the foot support bladder portion 210) through an end of the fifth fluid line region 206E) may enclose a volume that is: (a) less than 1% (and in some examples, less than 0.5%, less than 0.25%, less than 0.1%, or even less than 0.05%) of the volume V1 defined within the foot support bladder portion 210's interior chamber 210C and/or (b) less than 1% (and in some examples, less than 0.5%, less than 0.25%, less than 0.1%, or even less than 0.05%) of the volume V2 defined within the fluid reservoir portion 220's interior chamber 220C.

Additional features and uses of some examples of this technology will be described in more detail below with additional reference to FIGS. 2G and 2H. FIG. 2G shows a cross sectional view of fluid reservoir portion 220 taken along line 2G-2G in FIG. 2C with the bladder system 200 in a lower pressure foot support configuration (e.g., in which the fluid reservoir portion 220 and the foot support bladder portion 210 of this example are at an "equalized" pressure and switch member 400 is in the open position). FIG. 2H shows a cross sectional view of fluid reservoir portion 220 taken along line 2G-2G in FIG. 2C with the bladder system 200 in a higher pressure foot support configuration and switch member 400 is in the closed position (e.g., after fluid is moved out of the fluid reservoir portion 220 and into the foot support bladder portion 210). FIGS. 2G and 2H further illustrate that the bladder system 200 (e.g., fluid reservoir portion 220) may include one or more interior tensile elements 248, e.g., to help control the shape of the bladder system 200 when inflated. The foot support bladder portion 210 also may include one or more interior tensile elements 248 of this type (see also FIG. 2C). Tensile elements 248 may be made of materials and constructions conventionally known and used in the footwear arts.

As some more specific examples, the interior tensile element(s) 248 of this example include: (i) a first base element 248A (e.g., a fabric component) attached to an interior surface 200AI of thermoplastic elastomer layer 200A (e.g., by an adhesive); (ii) a second base element 248B (e.g., a fabric component) attached to an interior surface 200BI of thermoplastic elastomer layer 200B (e.g., by an adhesive); and (iii) a plurality of flexible connecting elements 248C (e.g., threads, fibers, yams, spacer mesh, etc.) extending between and connecting the first base element 248A and the second base element 248B. Thus, when the fluid reservoir portion 220 is inflated, as shown in FIG. 2G, the connecting elements 248C may limit the degree to which the fluid reservoir portion 220 can expand because connecting elements 248C limit the distance that base elements 248A and 248B (and the connected thermoplastic elastomer layers 200A, 200B, respectively) can separate from one another. In this manner, the interior tensile element(s) 248 can control the shape of inflated bladder portions in which they are included. Additionally or alternatively, internal welds or connections (where interior surface 200AI of thermoplastic elastomer layer 200A is welded or otherwise fixed to interior surface 200BI of thermoplastic elastomer layer 200B) may be provided for shape control purposes.

When switch member 400 is in the open configuration (e.g., as shown in FIGS. 1E, 1F, 1I, 1Q, and 2E), pressure is equalized throughout this example bladder system 200, the foot support bladder portion 210 is in a lower pressure foot support configuration, and the fluid reservoir portion 220 is in an expanded configuration as shown in FIG. 2G. At some point in time, switch member 400 will be moved to change fluid line 240 from the open configuration to the closed configuration (e.g., moving switch member 400 to the upward position shown in FIGS. 1G, 1H, 1J, and 2F). Once this change is made, fluid line 240 will be pinched closed (e.g., at the flap as shown in FIGS. 1J and 2F). Then, as the user walks (activating foot pump 220P via activator 506 in this example), fluid will incrementally move (step-by-step) from the fluid reservoir portion 220 to the foot support bladder portion 210 and stay in the foot support bladder portion 210 (because fluid line 240 is closed and check valve 224 prevents backflow into the pump 220P).

As fluid moves into the foot support bladder portion 210, pressure will increase in the foot support bladder portion 210, e.g., because any substantial volume change may be limited by tensile element(s) 248 contained therein. But, as fluid moves out of the fluid reservoir portion 220, pressure will decrease in the fluid reservoir portion 220. Eventually, if and when sufficient fluid is moved out, the fluid reservoir portion 220 may begin to collapse and decrease in height. FIGS. 2G and 2H illustrate fluid reservoir portion 220 changing in height from H1 to H2 as fluid moves out of fluid reservoir portion 220 and into foot support bladder portion 210. Fluid may continue to be pumped out of fluid reservoir portion 220 (e.g., via foot activated pump 220P) until the fluid reservoir portion 220 is empty (or nearly empty). In some examples of this technology, such as in the article of footwear 100 structure shown in FIGS. 1A-1O and 1Q, this height decrease in fluid reservoir portion 220 may be observed visually (e.g., because the fluid reservoir portion 220 is visible and/or exposed in the sole structure 500 and/or because the sole structure 500 height change is otherwise made visibly observable).

When the bladder system 200, sole structure 500, and article of footwear 100 are in the configuration shown in FIG. 2H, movement of the switch member 400 from the closed configuration (the upward position) to the open configuration (the downward position) in this example will switch the bladder system 200, sole structure 500, and article of footwear 100 from the higher pressure foot support configuration to the lower pressure foot support configuration. In at least some examples of this technology, this change will open fluid line 240 and equalize pressure throughout the bladder system 200. Further, in some examples of this technology, this change will be accompanied by (a) a change in foot support pressure (from harder to softer) and (b) a height change in the fluid reservoir portion 220 (from H2 to H1). A height change also may be observed in the overall sole structure 500 and article of footwear 100. In at least some examples of this technology, the foot support pressure change (from harder to softer) and the height change may take place substantially instantaneously (e.g., in less than 2 seconds after the switch member 400 is moved to the open configuration (downward position). Alternatively, if desired, fluid flow rate controllers and/or other ways of slowing fluid transfer through fluid lines 230, 240 may be provided to control the rate at which the bladder system 200, sole structure 500, and article of footwear 100 change between these conditions, e.g., to produce a more gradual pressure change and/or height change.

In at least some examples of this technology, the entire bladder system 200 may be formed from two layers 200A, 200B of thermoplastic elastomer material (e.g., one or more thermoplastic elastomer sheets welded together via one or more seams 208 in manners known and used in the art). In such structures, the entire interior of the bladder system 200 (e.g., interior chamber 210C, interior chamber 220C, interior fluid channel 230C of fluid line 230, interior fluid channel 240C of fluid line 240, and pump interior chamber 222C) may be in fluid communication with one another. A single continuous perimeter seam 208 may extend completely around the exterior perimeter of the bladder system 200 where the layers 200A and 200B meet and are fixed together, and this single continuous perimeter seam 208 may extend to form and/or define at least portions of: (a) the interior chamber 210C, (b) the interior chamber 220C, (c) the interior fluid channel 230C of fluid line 230, and (d) the interior fluid channel 240C of fluid line 240. Additionally or alternatively, as shown in FIGS. 2C and 2D, the perimeter seam 208 may extend continuously from a region forming an exterior edge of the interior chamber 210C of foot support bladder portion 210 to a region forming the exterior edge of the flap including fluid line portion 200P of fluid line 240. This same continuous seam 208 may extend to form the remainder of the flap, the outside edge of fluid line 240, and the exterior edge of the interior chamber 220C of fluid reservoir portion 220. This same continuous seam 208 also may extend to form the outside edge of fluid line 230 and the remainder of the exterior edge of interior chamber 210C. Additionally or alternatively, as further shown in FIGS. 2C and 2D, the seams 208 may be formed such that the interior chambers 210C and 220C extend continuously to form (e.g., to morph into) the interior fluid channels 230C and 240C of fluid lines 230 and 240, respectively. Such continuous structures may avoid the need for separate port component hardware parts for attaching separate fluid lines 230, 240 (e.g., as tubing) to the foot support bladder portion 210 and fluid reservoir portion 220. Additional interior seams may be provided in the bladder system 200, e.g., to define the pump interior chamber 222C, to separate fluid lines 230 and 240 from one another and/or from interior chamber(s) 210C and/or 220C, and/or for shape control, etc. Any necessary hardware for the valves 224 and/or 226 may be placed at appropriate locations at an appropriate time in the production process, e.g., before layers 200A and 200B are connected to form seam 208.

A single inflation port 200I opening into one of these interior fluid chambers of the bladder system 200 (opening into fluid reservoir interior chamber 220C in the example of FIG. 2C) may be provided and may be configured to inflate each of the foot support bladder portion 210, the fluid reservoir portion 220, fluid line 230, and fluid line 240 (and pump chamber interior 222C). Once inflated, the port 200I may be sealed, and the bladder system 200 may function as a closed, fluid-tight system.

Figure 3A:
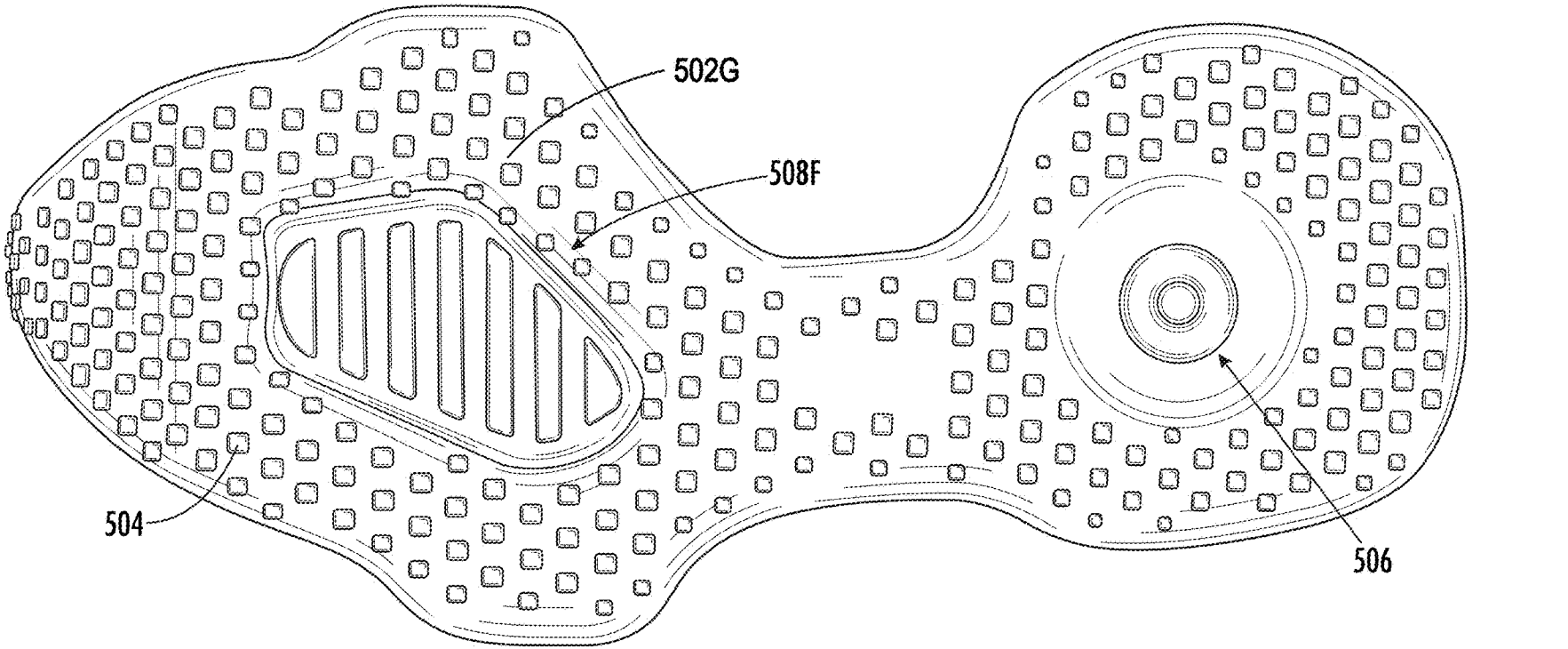
FIGS. 3A-3C provide various views of outsole components in accordance with some examples and aspects of this technology.
Figure 3B:
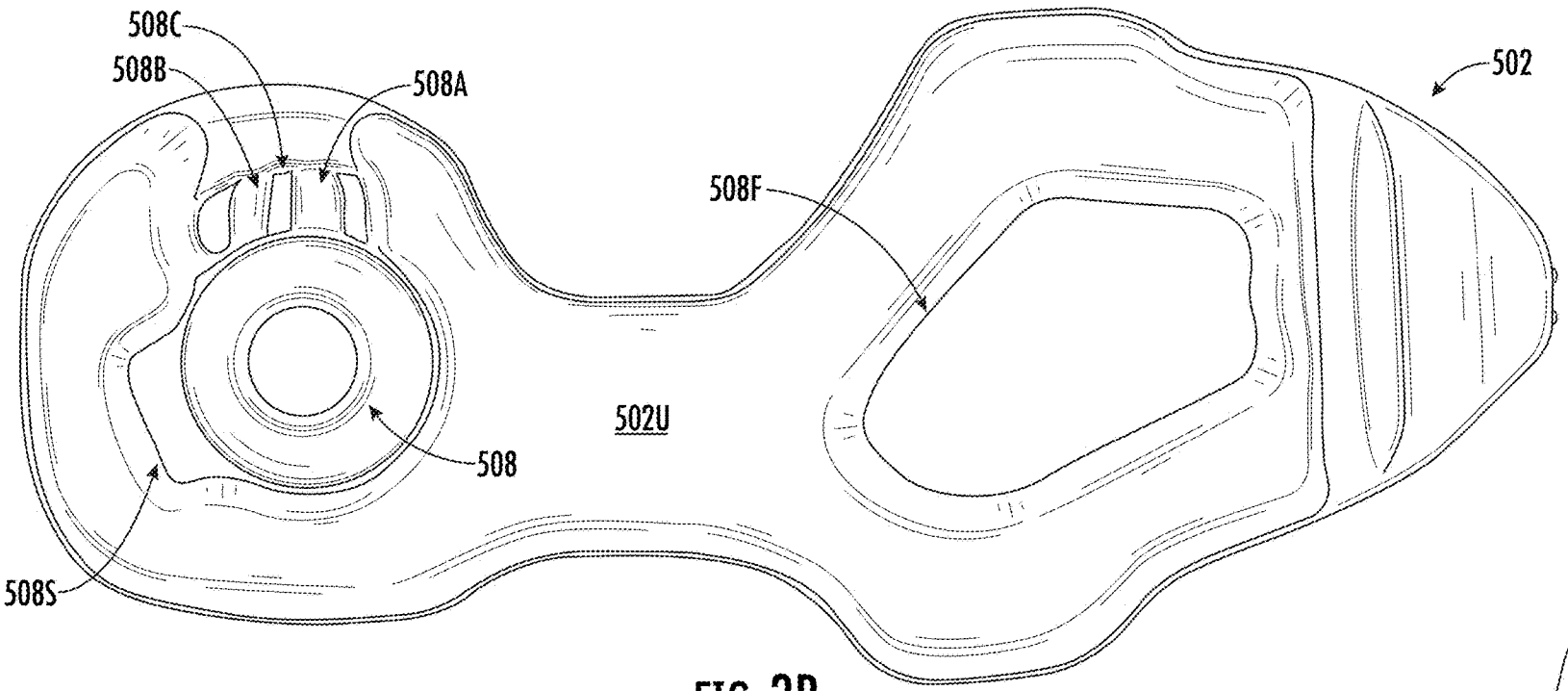
Figure 3C:
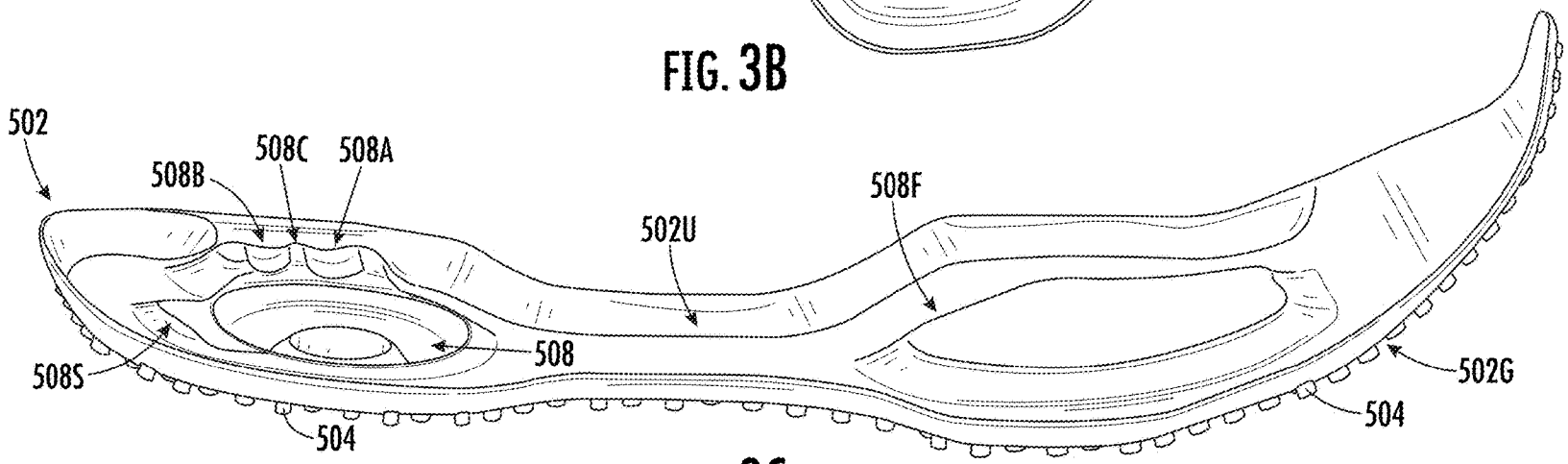

Additional features of component parts in this example sole structure 500 and article of footwear 100 will be described below with additional reference to FIGS. 3A-7B. FIGS. 3A, 3B, and 3C provide bottom, top, and perspective views, respectively, of outsole 502 in accordance with some aspects of this technology. The outsole 502 may be formed from one or more outsole component parts and/or may be made of any desired outsole materials, including outsole component parts and/or outsole materials (e.g., rubbers, thermoplastic polyurethanes, other thermoplastics, etc.) conventionally known and used in the footwear arts. Outsole 502 may include one or more traction elements 504 at its ground-contacting surface 502G, e.g., including traction elements 504 of types conventionally known and used in the footwear arts (e.g., cleats, spikes, ridges, recesses, nubs, etc.). The outsole 502 of this specific example comprises a relatively thin sheet or plate like component, e.g., that is molded from one or more of the materials described above.

Outsole 502 of this example further includes a pump activator 506, e.g., located in a heel region of the sole structure 500, for activating pump 220P of the bladder system 200 (e.g., compressing a bulb-type pump 220P). The forwardmost extent or edge of the pump activator 506 may be located: (a) rearward of a parallel plane located at 0.33L, and in some examples, rearward of a parallel plane located at 0.3L, and (b) forward of a parallel plane located at 0.15L, and in some examples, forward of a parallel plane located at 0.2L. The rearwardmost extent or edge of the pump activator 506 may be located: (a) rearward of a parallel plane located at 0.2L, and in some examples, rearward of a parallel plane located at 0.15L, and (b) forward of a parallel plane located at 0.05L, and in some examples, forward of a parallel plane located at 0.08L. These parallel plane locations are based on a longitudinal length of any one or more of the outsole 502, the sole structure 500, and/or the article of footwear 100. The pump activator 506 may project downward from a base surface level of the ground-contacting surface 502G, e.g., as shown in FIGS. 1C-1F, so as to readily contact the ground when landing a step or jump.

Outsole 502 further includes an upper-facing surface 502U opposite ground-contacting surface 502G. See FIG. 3B. Upper-facing surface 502U of the outsole 502 in this example footwear structure 100 directly contacts the bottom surface of the fluid reservoir portion 220 of bladder system 200. The upper-facing surface 502U of this example includes a recessed area 508 located opposite the pump activator 506. This recessed area 508 is sized, shaped, and configured to receive the bottom portion of the outer surface of pump 220P. Adjacent the recessed area 508, this example upper-facing surface 502U includes two support surfaces: (a) support surface 508A (e.g., a recess) that is sized, shaped, and configured to receive the bottom portion of fluid line 230 and (b) support surface 508B (e.g., a recess) that is sized, shaped, and configured to receive the bottom portion of fluid line 240 (e.g., part of the sixth fluid line region 206F extending away from the flap). Support surface(s) 508A and/or 508B may be partial (e.g., one-half or one-third) cylinder shaped (e.g., shaped like the inside surface of a cylinder with a rounded cross section) so that fluid lines 230 and 240 can fit inside without being crushed or pinched closed. Additionally or alternatively, this example upper-facing surface 502U includes an additional support area 508S, e.g., extending rearward from the pump engaging recessed area 508. This support area 508S is located to accommodate pump inlet 220PI and check valve 226 in the specific example shown in FIG. 2C. Additionally or alternatively, this example upper-facing surface 502U includes a raised forward support area 508F, e.g., located in the midfoot area and/or forefoot area of the outsole 502. This raised forward support area 508F corresponds to the recess located at the ground-contacting surface 502G and extends to contact a bottom surface of a thinned area 220T of the fluid reservoir portion 220 located forward of the pump 220P (see FIG. 2C).

Support surface(s) 508A and/or 508B of this illustrated example extend sideways from the recessed area 508 provided for accommodating pump 220P toward a medial side edge of the outsole component 502. The support surfaces 508A and 508B in this example are located adjacent one another and are separated by a raised ridge 508C of outsole material. The forwardmost extent or edge of support surface 508A in this example structure may be located: (a) rearward of a parallel plane located at 0.3L, and in some examples, rearward of a parallel plane located at 0.25L, and (b) forward of a parallel plane located at 0.15L, and in some examples, forward of a parallel plane located at 0.2L. The rearwardmost extent or edge of support surface 508B in this example structure may be located: (a) rearward of a parallel plane located at 0.2L, and in some examples, rearward of a parallel plane located at 0.16L, and (b) forward of a parallel plane located at 0.05L, and in some examples, forward of a parallel plane located at 0.08L. These parallel plane locations are based on a longitudinal length of any one or more of the outsole 502, the sole structure 500, and/or the article of footwear 100.

Figure 4A:
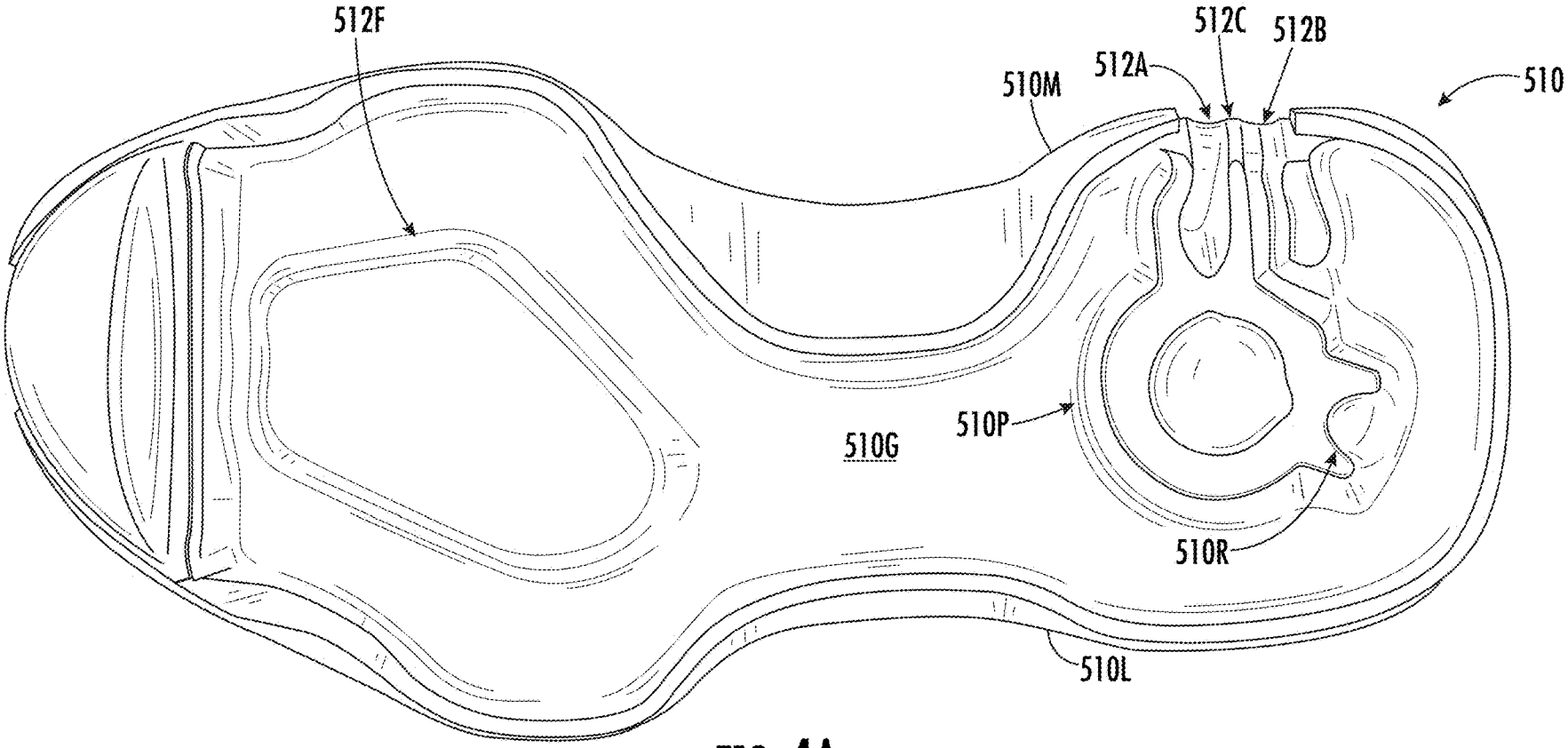
FIGS. 4A-4D provide various views of midsole components in accordance with some examples and aspects of this technology.
Figure 4B:
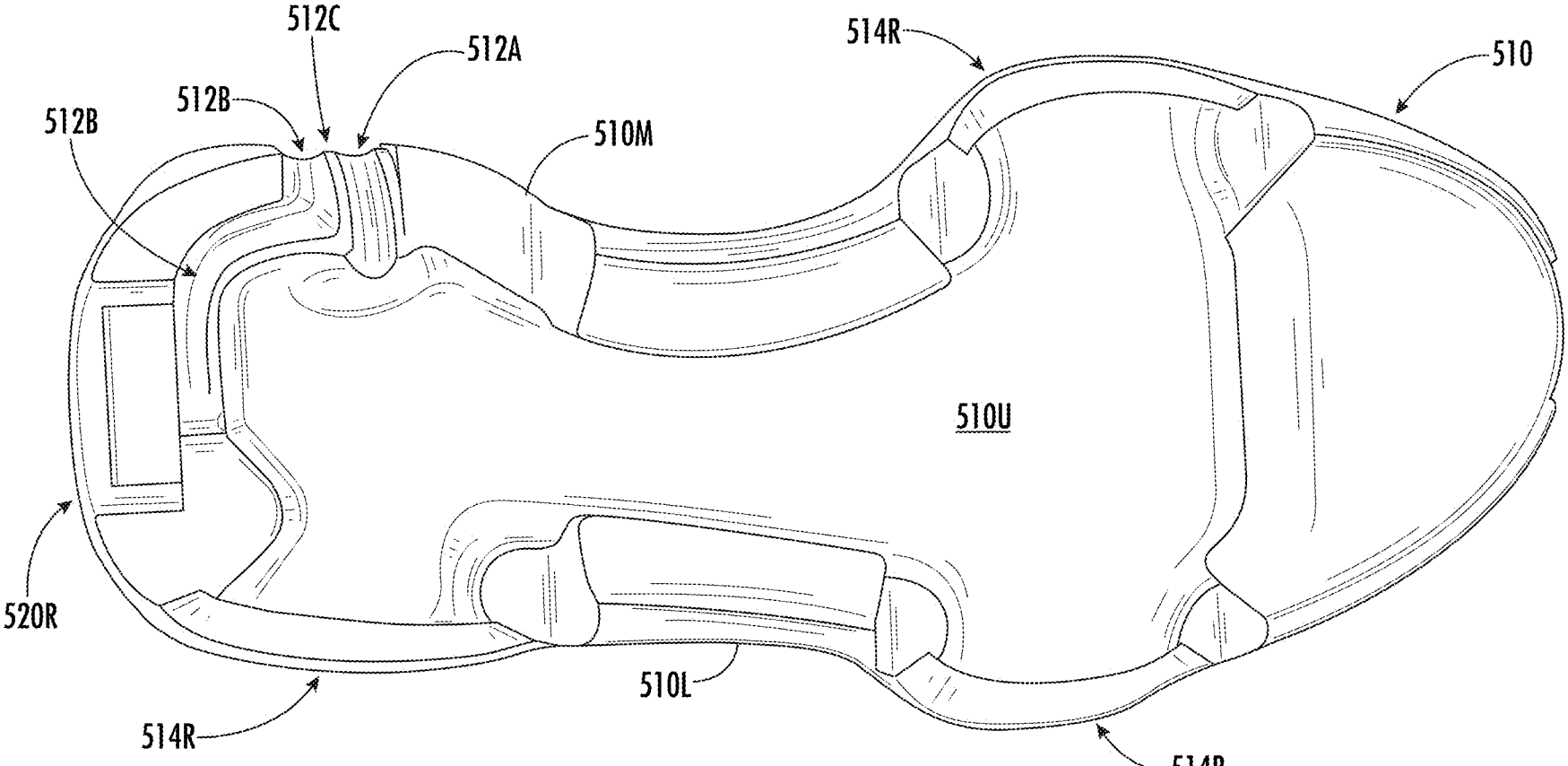
Figure 4C:
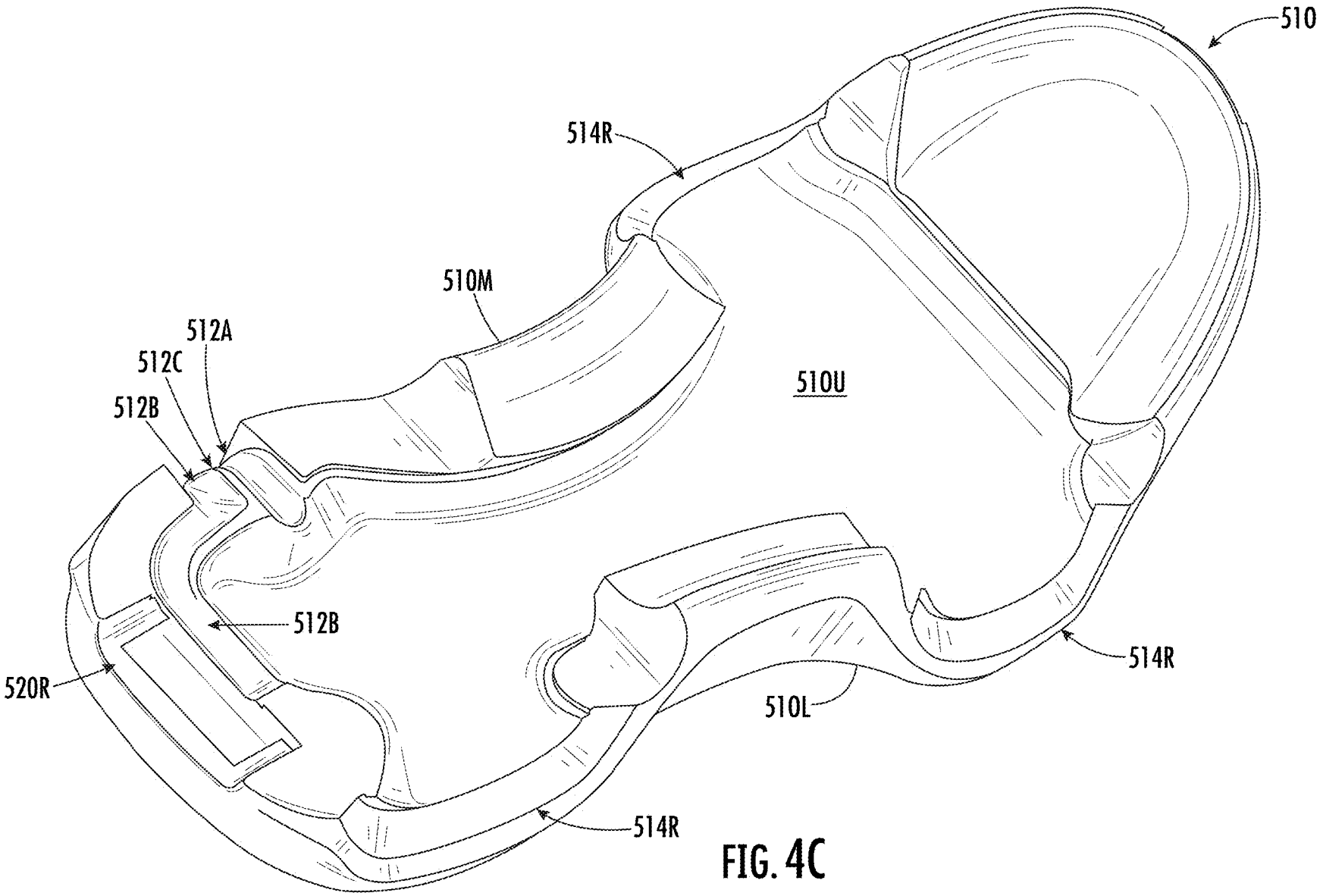
Figure 4D:
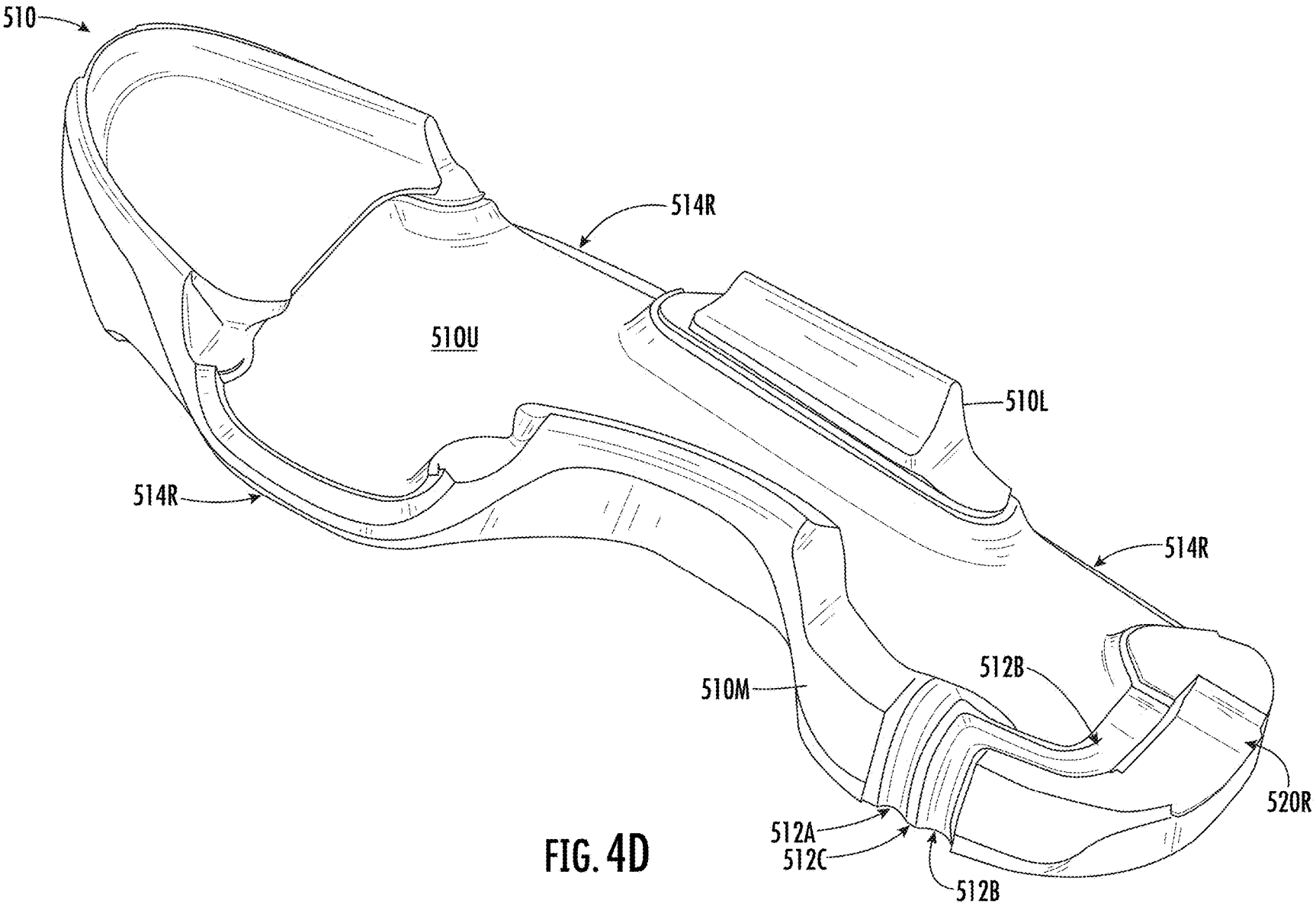

FIGS. 4A-4D provide various views of midsole 510 (e.g., a lower midsole component) according to this specific example of the present technology. FIG. 4A provides a bottom view (of the ground-facing surface 510G) of midsole 510; FIG. 4B provides a top view (of the upper-facing surface 510U) of midsole 510; and FIGS. 4C and 4D provide top perspective views of midsole 510. Midsole 510 may be formed from one or more component parts, including one or more foam elements (e.g., made from polyurethane foams, ethylvinylacetate foams, and/or other foam materials as are conventionally known and used in the footwear arts). As shown in FIGS. 1C-1O, in this example article of footwear 100 and sole structure 500, the ground-facing surface 510G of midsole 510 overlies (e.g., and contacts) the upper-facing surface of the fluid reservoir portion 220 of bladder system 200 and the upper-facing surface 510U of midsole 510 underlies (e.g., and contacts) the ground-facing surface of the foot support bladder portion 210 of bladder system 200.

The ground-facing surface 510G of midsole 510 includes a pump-engaging area 510P, e.g., that is sized, shaped, and configured to receive the top portion of the outer surface of pump 220P. This pump-engaging area 510P includes a recessed area located to vertically align with the pump activator 506 and recessed area 508 of outsole 502. The pump-engaging area 510P further includes a recessed area 510R (e.g., at its rearmost region) sized, shaped, and configured to accommodate pump inlet 220PI and valve 226 (see FIG. 2C). The forwardmost edge or extent and the rearwardmost edge or extent of pump-engaging area 510P may be located within any of the parallel plane regions described above for the pump activator 506 of outsole 502. Additionally or alternatively, this example ground-facing surface 510G includes a downwardly projecting forward support area 512F, e.g., located in the midfoot area and/or forefoot area of the midsole 510. This forward support area 512F corresponds to the raised forward support area 508F of outsole 502 and extends to contact the top of the thinned area 220T of the fluid reservoir portion 220.

Adjacent the pump-engaging area 510P, the ground-facing surface 510G of this example midsole 510 includes two support surfaces: (a) support surface 512A (e.g., a recess) that is sized, shaped, and configured to receive the top portion of fluid line 230 and (b) support surface 512B (e.g., a recess) that is sized, shaped, and configured to receive the top portion of fluid line 240 (e.g., part of the sixth fluid line region 206F extending away from the flap). Support surface(s) 512A and/or 512B may be partial (e.g., one-half or one-third) cylinder shaped (e.g., shaped like the inside surface of a cylinder with a rounded cross section) so that fluid lines 230 and 240 can fit inside without being crushed or pinched closed. Support surface(s) 512A and/or 512B of this illustrated example extend sideways from the pump-engaging area 510P provided for accommodating pump 220P toward a medial side edge of the midsole 510. The support surfaces 512A and 512B in this example are located adjacent one another and are separated by a raised ridge 512C of midsole material. The forwardmost edge or extent and the rearwardmost edge or extent of support surfaces 512A, 512B may be located within any of the parallel plane regions described above for the support surfaces 508A, 508B, respectively, of outsole 502. Support surfaces 512A and 512B at the ground-facing surface 510G of midsole 510 cooperate with support surfaces 508A and 508B, respectively, at the upper-facing surface 502U of outsole 502 to form a channel through which fluid lines 230 and 240, respectively, can extend without being crushed or pinched closed.

Support surface(s) 512A and/or 512B of this example include recesses that extend around the medial sidewall 510M of midsole 510 from the ground-facing surface 510G to the upper-facing surface 510U. At the upper-facing surface 510U of midsole 510, the support surfaces 512A and 512B are recesses configured to support the bottom portions of fluid lines 230, 240. Support surface 512B (e.g., for fluid line 240 (e.g., part of the sixth fluid line region 206F extending away from the flap)) continues along the upper-facing surface 510G of midsole 510 to the rear heel area of the midsole 510 adjacent recess 520R provided to accommodate fluid line portion 200P of bladder system 200 (the flap) and at least a portion of the switch member 400. Support surface 512B at the upper-facing surface 510U in this example has a curved shape extending along and inside a medial, rear heel perimeter area of the midsole 510.

Figure 5A:
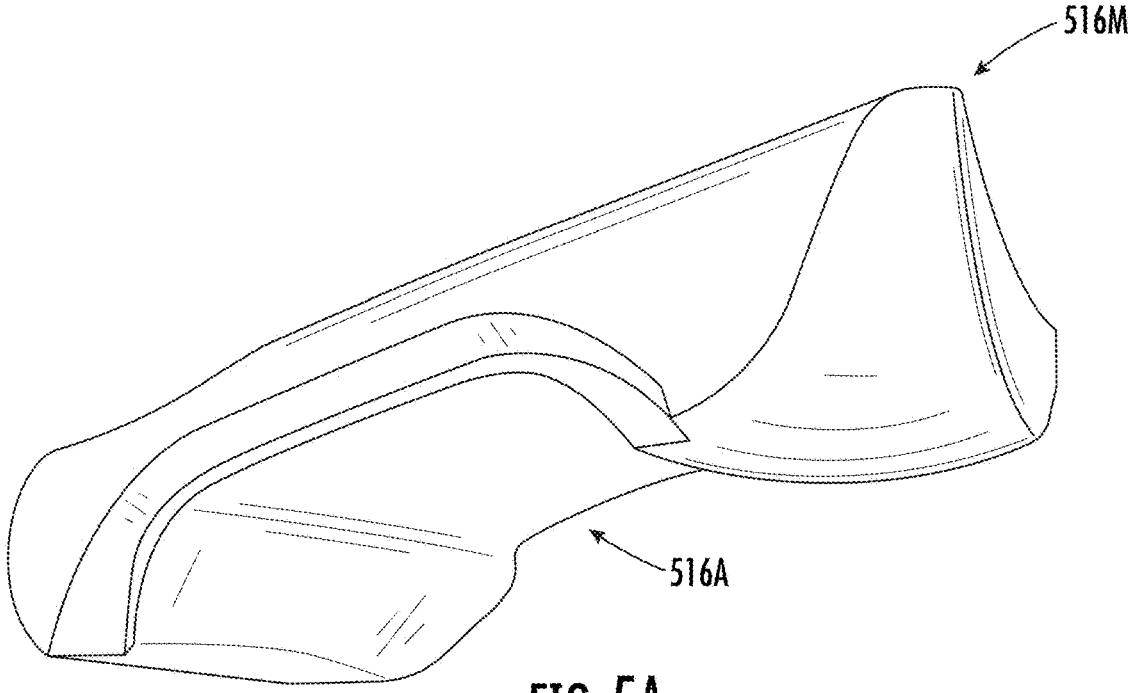
FIGS. 5A and 5B provide views of additional midsole or other footwear components in accordance with some examples and aspects of this technology.
Figure 5B:
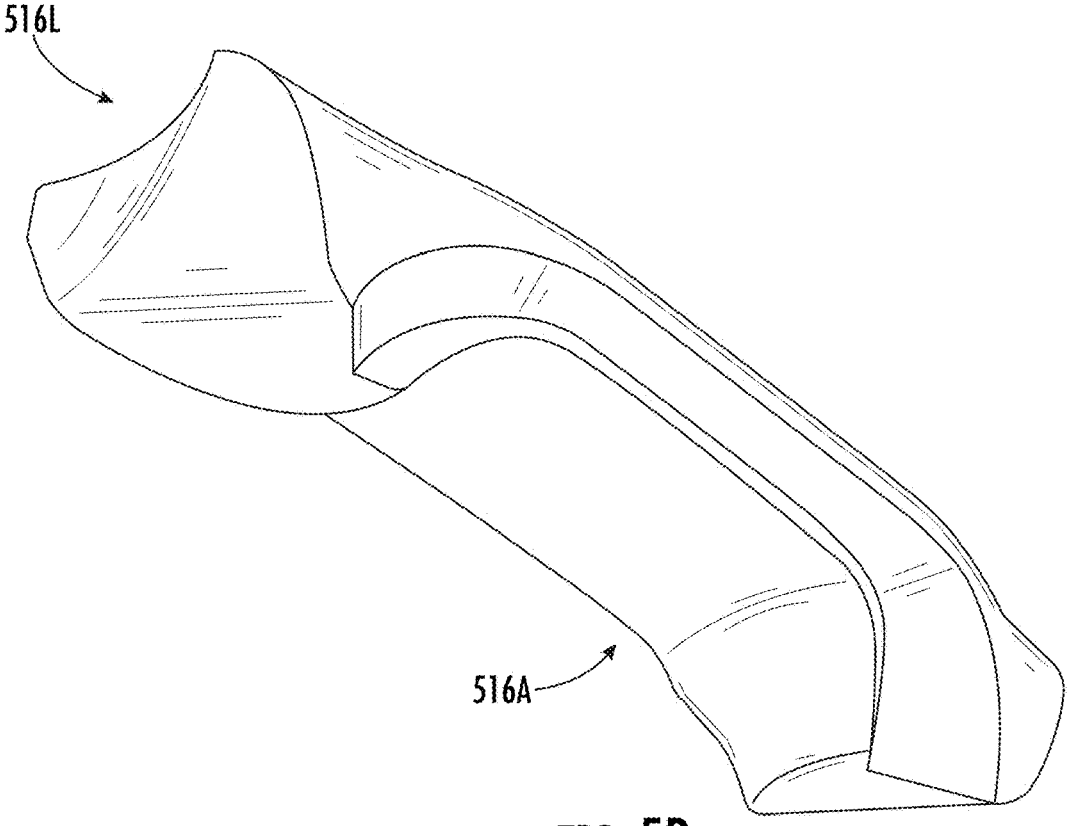

FIGS. 4B-4D further show that this example midsole 510 includes recesses 514R formed in the medial sidewall 510M and the lateral sidewall 510L. These recesses 514R form the bottom portions of the openings 510H through which side edges of the foot support bladder portion 210 are visible (and exposed). FIG. 5A shows an additional medial midsole component 516M that forms the top portion of the forefoot medial opening 510H and FIG. 5B shows an additional lateral midsole component 516L that forms the top portion of the forefoot lateral opening 510H in this example sole structure 500 and article of footwear 100. While other sizes, shapes, and/or structures are possible, each of medial midsole component 516M and lateral midsole component 516L of this specific example defines an arched recess 516A through which the foot support bladder portion 210 is visible (and exposed). Medial midsole component 516M and lateral midsole component 516L may be made of any of the same materials that may be used for forming midsole 510 as described above (e.g., foam materials) and/or plastic materials.

The recesses 514R and/or arched recesses 516A may have a wide variety of sizes, shapes, configurations, relative spacings, and aesthetic appearances without departing from this technology. Alternatively, in some examples of this technology, one or more of the recesses 514R and/or arched recesses 516A (and optionally the openings 510H) may be omitted from the sole structure 500.

Figure 6A:
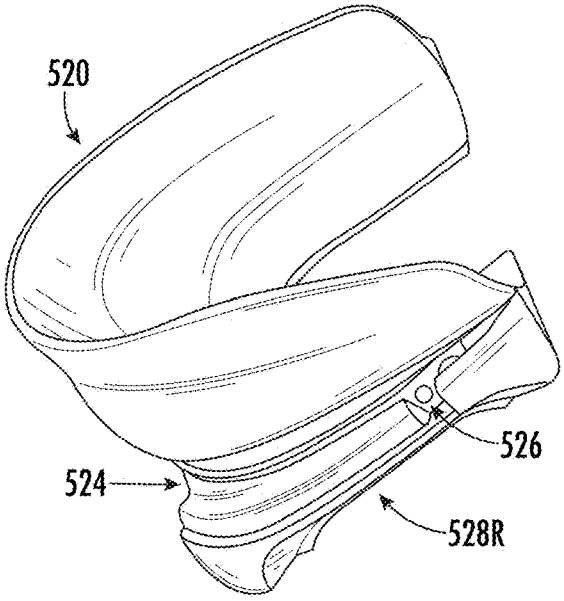
FIGS. 6A-6C provide various views of heel components in accordance with some examples and aspects of this technology.
Figure 6B:
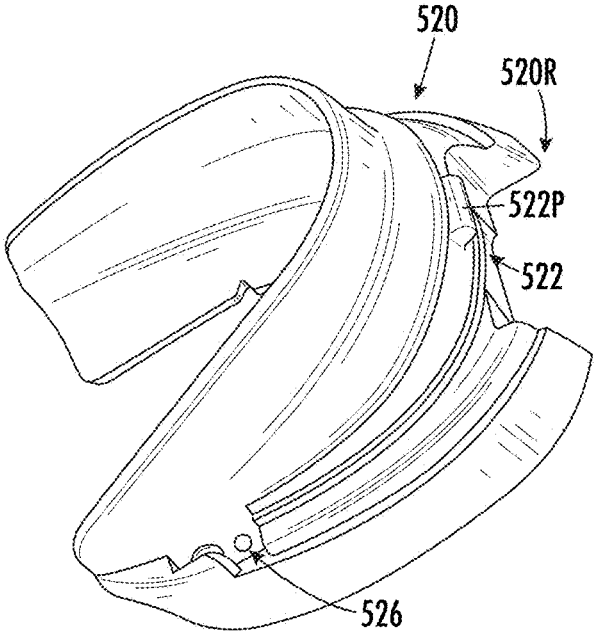
Figure 6C:
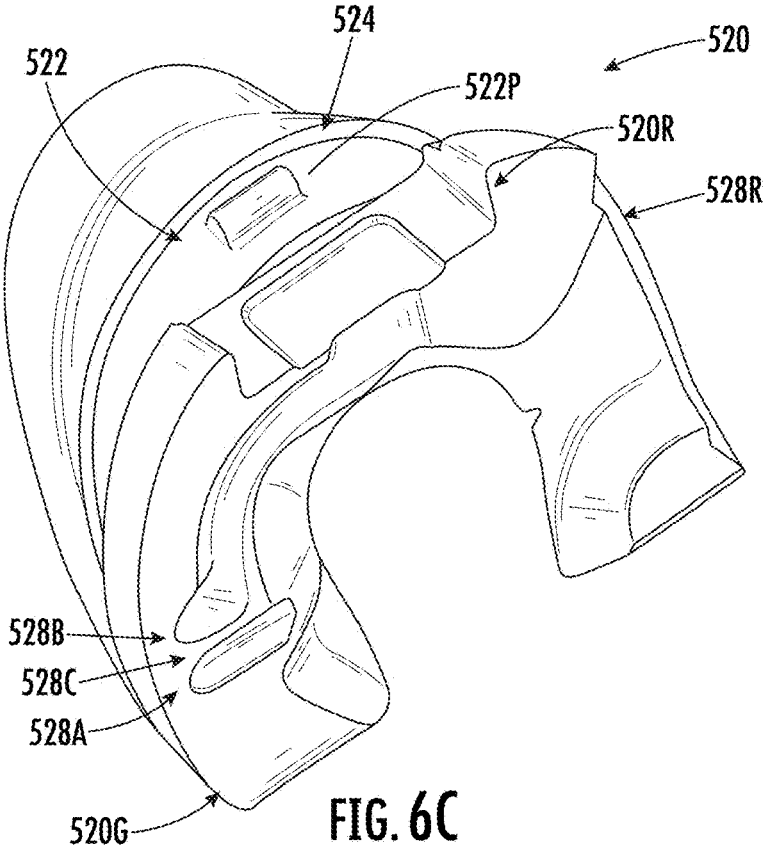
Figure 7A:
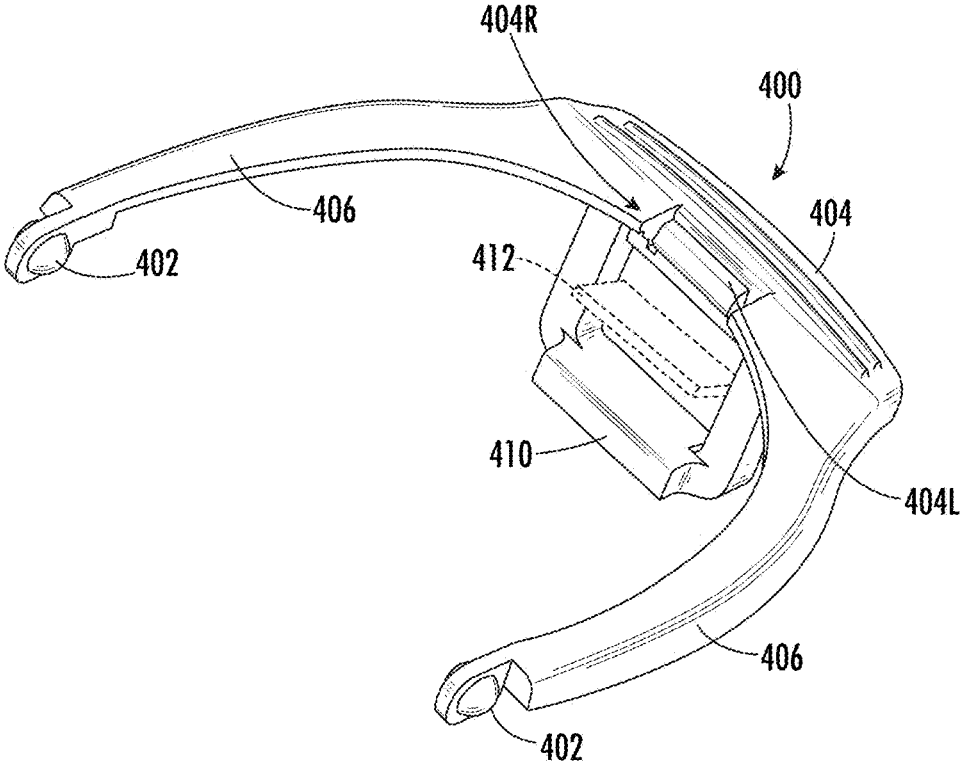
FIGS. 7A and 7B provide various views of switch members in accordance with some examples and aspects of this technology.
Figure 7B:
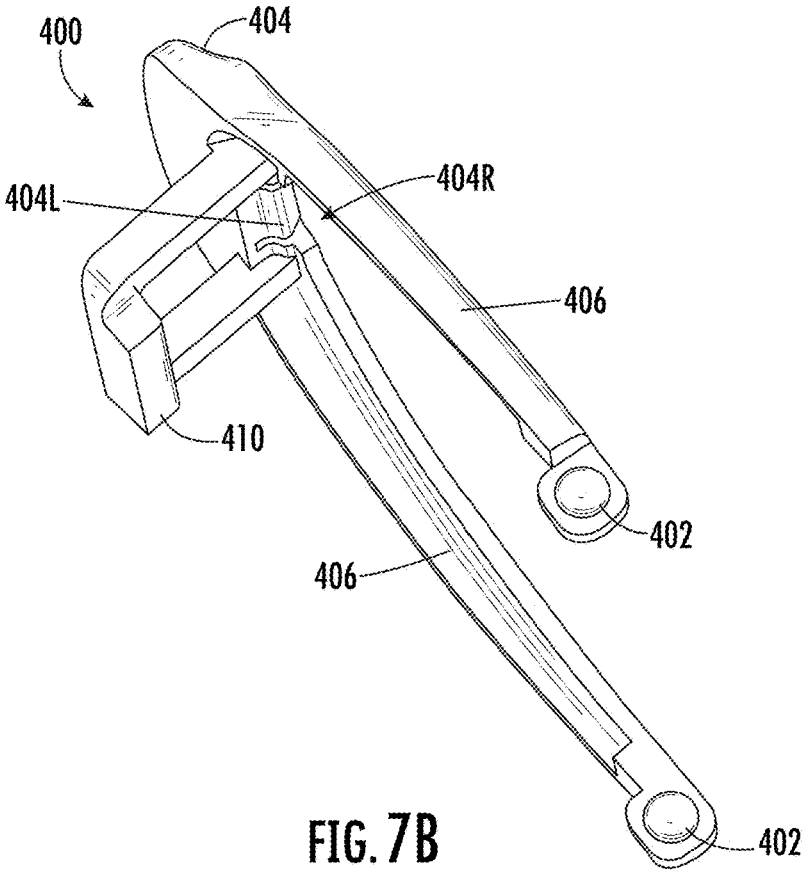

FIGS. 6A-6C show various perspective views of heel component 520 and FIGS. 7A and 7B show perspective views of the switch member 400 of this example structure. As described above, heel component 520 (and/or the midsole 510) defines a recess 520R (e.g., at a rear heel area) that provides space to accommodate fluid line portion 200P (the flap) of bladder system 200 and at least a portion of the switch member 400. The heel component 520 may be made from plastic or other suitable material, e.g., materials conventionally known and used for footwear heel counter type structures. The switch member 400 may be made from plastic, metal, and/or other appropriate materials.

As further shown in FIGS. 6B and 6C, the heel component 520 includes latch member 522 (e.g., including a latching projection 522P) over which a latch engaging portion 404L (in recess 404R) of switch member 400 can extend and engage to latch the switch member 400 in the upward position. Additionally or alternatively, a latch member (of the same or different structure) may be provided to hold the switch member 400 at the downward position. This example heel component 520 further includes a recessed area 524 along the exterior surface at the sides and rear area to accommodate the arms 406 and a portion of the base of switch member 400 that includes the recess 404R and latch engaging portion 404L. Pivot supports 402 located at the free ends of arms 406 pivotally engage openings 526 (or other structure) provided in the heel component 520 (e.g., in recessed area 524) to movably engage the switch member 400 with (and with respect to) the heel component 520. Pivot supports 402 and openings 526 (or other structures) provide pivot anchor points for the arms 406 of switch member 400. The recessed area 524 can help limit the extent of pivot of the switch member 400 in the upward and/or downward directions.

FIGS. 6A and 6C show additional potential features of heel component 520. For example, FIGS. 6A and 6C show that the bottom edge of heel component (e.g., at the lateral side in this example) includes a recess 528R. This recess 528R defines the upper part of lateral heel opening 510H shown in FIGS. 1E and 1G (and through which a lateral heel area of foot support bladder chamber 210 is visible and exposed in this example). The recess 528R may have a wide variety of sizes, shapes, configurations, and aesthetic appearances without departing from this technology. Alternatively, in some examples of this technology, the recess 528R (and optionally the lateral heel opening 510H) may be omitted from the sole structure 500.

FIG. 6C further illustrates that the ground-facing surface 520G of this example heel component 520 includes support surfaces 528A and 528B (e.g., at the medial side, in this illustrated example). These support surfaces 528A and 528B include recesses that are sized, shaped, and configured to receive the top portion of fluid lines 230 and 240, respectively. Support surface(s) 528A and/or 528B may be partial (e.g., one-half or one-third) cylinder shaped (e.g., shaped like the inside surface of a cylinder with a rounded cross section) so that fluid lines 230 and 240 can fit inside without being crushed or pinched closed. Portions of the support surfaces 528A and 528B in this example are located adjacent one another and are separated by a raised ridge 528C of heel component 520 material. The forwardmost edge or extent and the rearwardmost edge or extent of support surfaces 528A, 528B may be located within any of the parallel plane regions described above for the support surfaces 508A, 508B, respectively, of outsole 502.

Support surfaces 512A and 512B at the upper-facing surface 510U of midsole 510 cooperate with support surfaces 528A and 528B, respectively, at the ground-facing surface 520G of heel component 520 to form a channel through which fluid lines 230 and 240, respectively, can extend without being crushed or pinched closed. Support surface 528B at the ground-facing surface 520G in this example further includes a curved shape extending along and inside a medial, rear heel perimeter area of the heel component 520. This support surface 528B is shaped to align with support surface 512B at the upper-facing surface 510U of midsole 510 to provide support and an open channel through which fluid line 240 extends away from the flap (which will be located in recess 520R in this illustrated example).

The examples described above and illustrated in the figures include portions of fluid lines 230 and 240 located immediately adjacent one another. Thus, at least portions of the various support structures for these fluid lines (e.g., support surfaces 508A, 508B on the upper-facing surface of outsole 502; support surfaces 512A and 512B of midsole 510; and support surfaces 528A and 528B of heel component 520) are located immediately adjacent one another. Other structures are possible. For example, if desired, fluid lines 230 and 240 may be separated from another and/or may extend from separated locations of the foot support bladder chamber 210 and/or the fluid reservoir chamber 220. In such structures, the support surfaces 508A and 508B may be separated from one another and/or support surfaces 512A and 512B may be separated from one another and/or support surfaces 528A and 528B may be separated from one another. In other examples, one or more of the support surfaces 508A, 508B, 512A, 512B, 528A, and/or 528B may be omitted (e.g., and the fluid lines 230 and/or 240 may extend through gaps or recesses in the outsole 502 and/or midsole 510 and/or heel component 520).

While the specific example structures shown in FIGS. 1A-7B include a switch member 400 mounted to an article of footwear 100 (e.g., to a heel component 520) to pinch fluid line 240 closed, other types of closure elements, closure element structures, and/or options are possible in other examples of this technology. For example, a clamp, clip, or stopcock type structure could be provided at or near fluid line portion 200P (the flap) to collapse fluid line 240 (e.g., and pinch it closed). As another example, rather than a pivoting switch member 400, the switch member 400 could be slidably mounted on a heel component 520 (and/or to the upper 102 and/or sole structure 500) and slide upward and downward to change between the open and closed configurations. As still other examples, if desired, rather than the manual switch member 400 illustrated in FIGS. 1A-1O and 1Q, electronically controlled switching systems may be used to open and close fluid line 240 (e.g., electronic controls of the types described in U.S. Pat. No. 11,206,896 B2, U.S. Pat. No. 11,234,485 B2, and/or U.S. Provisional Patent Appln. No. 63/541,431).

Also, while the example bladder systems 200 shown in FIGS. 1A-2H show the flap including the portion 200P of fluid line 240 extending outward from a surface of the foot support bladder portion 210, if desired, the flap and/or portion 200P of fluid line 240 could be provided at other portions of the overall bladder systems 200. For example, if desired, the flap portion may extend outward from the fluid reservoir portion 220 of bladder systems 200 and/or the first fluid line region 206A of portion 200P of fluid line 240 may directly open into the interior chamber 220C of the fluid reservoir portion 220 of bladder systems 200.

Further, while FIGS. 1A-2H shows recess 520R, fluid line portion 200P, and switch member 400 contact surfaces 410, 412 located at a rear heel region of the sole structure 500 and article of footwear 100, these (or similar) components may be provided at other locations in the sole structure 500 and/or article of footwear 100, such as at a medial side heel region, at a lateral side heel region, at a medial side midfoot region, at a lateral side midfoot region, at a medial side forefoot region, at a lateral side forefoot region, and/or at a forward toe region.

In the illustrated examples, during a step, the pump 220P moves fluid incrementally (e.g., step-by-step) from the fluid reservoir portion 220 into the foot support bladder portion 210. Alternatively, if desired, the pump 220P and valves 224 and 226 could be oriented to move fluid in the other direction, i.e., during a step, the pump 220P may move fluid incrementally (e.g., step-by-step) from the foot support bladder portion 210 into the fluid reservoir portion 220. Such fluid systems are described, for example, in one or more of: (a) U.S. Pat. No. 11,206,896 B2, (b) U.S. Pat. No. 11,234,485 B2, (c) U.S. Provisional Patent Appln. No. 63/477,719 filed Dec. 29, 2022, (d) U.S. Provisional Patent Appln. No. 63/498,593 filed Apr. 27, 2023, (e) U.S. Provisional Patent Appln. No. 63/541,431 filed Sep. 29, 2023, and/or (f) U.S. Provisional Patent Appln. No. 63/604,566 entitled "Bladder Systems with Closable Fluid Line and Foot Supports Including Such Bladder Systems." The footwear structures described herein may be used with bladder systems of the types that move fluid (step-by-step) in a direction from a foot support bladder portion 210 into a fluid reservoir portion 220, e.g., by orienting valve 224 in FIG. 2C to function as a check valve at an inlet to pump 220P (to allow fluid to flow into pump 220P but not backflow into fluid line 230) and by orienting valve 226 to function as a check valve at an outlet to pump 200P (to allow fluid to flow out of pump 220P and into reservoir chamber 220 but not backflow into the pump 220 from the reservoi4 chamber 220). In such systems, fluid will flow in the opposite direction from the broken line fluid flow arrows shown in FIG. 2C.

The terms "higher pressure foot support configuration" and "lower pressure foot support configuration" as used herein mean that the pressures are higher and lower relative to one another (e.g., the "higher pressure foot support configuration" is at a higher pressure than the "lower pressure foot support configuration" and the "lower pressure foot support configuration" is at a lower pressure than the "higher pressure foot support configuration"). While other ranges are possible, in some examples of this technology, the "lower pressure foot support configuration" may have the foot support bladder portion 210 at a pressure of less than 20 psi, less than 15 psi, less than 12 psi, between 8 psi and 20 psi, and/or between 10 psi and 20 psi. Additionally or alternatively, while other ranges are possible, in some examples of this technology, the "higher pressure foot support configuration" may have the foot support bladder portion 210 at a pressure of at least 15 psi, at least 18 psi, at least 20 psi, at least 25 psi, at least 28 psi, between 15 psi and 35 psi, between 18 and 35 psi, and/or between 20 psi and 30 psi.

Finally, while the figures herein show article of footwear 100 and bladder system 200 having specific sizes, shapes, and ornamental appearances, many variations in the sizes, shapes, and/or ornamental appearances of the various parts and combinations of parts may be provided without departing from this technology. For example, a sole structure 500 need not include one or more (or any) of the openings 510H, and/or the openings 510H, if present, may have a wide variety of sizes, shapes, locations, relative locations, and the like. Recess 520R and/or fluid line portion 200P (including the flap) also may have a wide variety of sizes, shapes, locations, and the like. Additionally or alternatively, recess 520R could be omitted, and a switch member may engage fluid line portion 200P at a location within the interior of a sole structure 500 and/or article of footwear 100 (and optionally in a manner such that the fluid line portion 200P is not visible at the exterior of the sole structure 500 or article of footwear 100). Switch member 400, e.g., including arms, recess 404R, and/or the latch member 522 with which it engages, also may have a wide variety of sizes, shapes, arrangements of components, and latch interacting parts that would still be able to interact with a fluid line portion 200P and latch in the desired manner. Any desired type of outsole 502 also may be present (e.g., with many different sizes, shapes, arrangements, and orientations of traction elements 504). Bladder system 200's foot support bladder portion 210, fluid reservoir portion 220, fluid line 230, and fluid line 240 may have a wide variety of sizes; shapes; orientations; relative sizes, shapes, and orientations; locations; relative locations; and arrangements without departing from this technology. As another example, while FIGS. 1F and 1H show the fluid lines 230, 240 exposed at the exterior of the sole structure 500 at the medial side, this is not a requirement. Rather, if desired, the fluid lines 230, 240 could be concealed within the sole structure 250 and/or upper, they could be located in other locations along the sole structure 250 (including on the lateral side), and/or a different portion or proportion of one or both fluid lines 230, 240 could be made visible. In general, the ornamental appearances of the various footwear 100 and bladder system 200 parts and portions illustrated in the drawings are not essential to their functions, as footwear 100, sole structure 250, and bladder system 200 parts and portions having many different appearances may be provided and still perform the desired functions in the desired manners as described above.

III. Conclusion

The present technology is disclosed above and in the accompanying drawings with reference to a variety of embodiments. The purpose served by the disclosure, however, is to provide an example of the various features and concepts related to this technology, not to limit the scope of the claimed invention. One skilled in the relevant art will recognize that numerous variations and modifications may be made to the embodiments described above without departing from the scope of the presently claimed invention, as defined by the appended claims.

For avoidance of doubt, this invention includes within its scope at least the subject matter defined in the following numbered "Clauses:"

Clause 1. An article of footwear, comprising:
- an upper formed from one or more component parts;
- a sole structure engaged with the upper, the sole structure including a foot support bladder chamber;
- a fluid reservoir chamber;
- a first fluid line extending between the foot support bladder chamber and the fluid reservoir chamber and placing the foot support bladder chamber in fluid communication with the fluid reservoir chamber, wherein the first fluid line extends outward from a heel area or a midfoot area of at least one of the foot support bladder chamber or the fluid reservoir chamber; and
- a closure element for changing the first fluid line between an open configuration and a closed configuration.

Clause 2. The article of footwear according to Clause 1, wherein the first fluid line extends through a flap that projects outward from a heel area of one of the foot support bladder chamber or the fluid reservoir chamber.

Clause 3. The article of footwear according to Clause 1, wherein the first fluid line extends through a flap that projects rearward from a rear heel area of one of the foot support bladder chamber or the fluid reservoir chamber.

Clause 4. The article of footwear according to Clause 2 or 3, wherein the flap includes: (a) a forward portion where a first end of the first fluid line receives fluid from one of the foot support bladder chamber or the fluid reservoir chamber and (b) a rearward portion forming a free end of the flap.

Clause 5. The article of footwear according to Clause 4, wherein the closure element comprises a switch mounted at a heel region of the upper, wherein the switch includes a contact portion that extends along a surface of the flap at a location between the forward portion and the rearward portion, and wherein movement of the switch causes the contact portion to induce movement of the rearward portion with respect to the forward portion.

Clause 6. The article of footwear according to Clause 4, wherein the closure element comprises a switch mounted at a heel region of the upper, wherein the switch includes a contact portion that extends along a surface of the flap at a location between the forward portion and the rearward portion, and wherein movement of the switch to change the first fluid line from the open configuration to the closed configuration moves the contact portion to create a pinched region in the first fluid line at a location between the rearward portion and the forward portion.

Clause 7. The article of footwear according to Clause 4, wherein the closure element comprises a switch, wherein the switch includes: (a) a medial side anchor point, (b) a lateral side anchor point, and (c) a contact portion extending along a surface of the flap at a location between the forward portion and the rearward portion, and wherein movement of the switch causes the contact portion to induce movement of the rearward portion with respect to the forward portion.

Clause 8. The article of footwear according to Clause 4, wherein the closure element comprises a switch, wherein the switch includes: (a) a medial side anchor point, (b) a lateral side anchor point, and (c) a contact portion extending along a surface of the flap at a location between the forward portion and the rearward portion, and wherein movement of the switch to change the first fluid line from the open configuration to the closed configuration moves the contact portion to create a pinched region in the first fluid line at a location between the rearward portion and the forward portion.

Clause 9. The article of footwear according to Clause 4, wherein the closure element comprises a switch, wherein the switch includes a medial side arm that extends from a medial side anchor point to a contact portion located along a surface of the flap between the forward portion and the rearward portion, and wherein movement of the switch causes the contact portion to induce movement of the rearward portion with respect to the forward portion.

Clause 10. The article of footwear according to Clause 4 or 9, wherein the closure element comprises a switch, wherein the switch includes a lateral side arm that extends from a lateral side anchor point to a contact portion located along a surface of the flap at a location between the forward portion and the rearward portion, and wherein movement of the switch causes the contact portion to induce movement of the rearward portion with respect to the forward portion.

Clause 11. The article of footwear according to any one of Clauses 5 to 10, further comprising a heel component fixed to at least one of the upper or the sole structure, wherein the switch is movably mounted to the heel component.

Clause 12. The article of footwear according to Clause 11, wherein the heel component includes a latching member, wherein the latching member engages a portion of the switch to hold the closure element in one of the open configuration or the closed configuration.

Clause 13. The article of footwear according to any one of Clauses 4 to 12, wherein a rear heel portion of at least one of the upper or the sole structure defines an opening or a recess through which the flap extends.

Clause 14. The article of footwear according to any one of Clauses 2 to 4, wherein the closure element comprises a clamp that is releasably engageable with the flap.

Clause 15. The article of footwear according to any one of Clauses 2 to 4, wherein the closure element comprises a stopcock.

Clause 16. The article of footwear according to any one of Clauses 1 to 15, further comprising: (i) a pump including an inlet and an outlet, wherein the inlet receives fluid from the fluid reservoir chamber; and (ii) a second fluid line connected with the outlet and in fluid communication with the foot support bladder chamber.

Clause 17. The article of footwear according to Clause 16, wherein the second fluid line extends between the outlet and the foot support bladder chamber at a medial heel region of the article of footwear.

Clause 18. The article of footwear according to Clause 15 or 16, wherein the pump is a foot activated pump.

Clause 19. The article of footwear according to any one of Clauses 15 to 18, wherein when the closure element places the first fluid line in the closed configuration, activation of the pump moves fluid from the fluid reservoir chamber to the foot support bladder chamber, decreases fluid pressure in the fluid reservoir chamber, and increases fluid pressure in the foot support bladder chamber.

Clause 20. The article of footwear according to Clause 19, wherein sufficient reduction in the fluid pressure in the fluid reservoir chamber induces a decrease in a height dimension of the fluid reservoir chamber.

Clause 21. The article of footwear according to Clause 19, wherein sufficient reduction in the fluid pressure in the fluid reservoir chamber induces a decrease in a height dimension of the sole structure.

Clause 22. The article of footwear according to any one of Clauses 1 to 21, wherein when the first fluid line is in the open configuration, the article of footwear is in a low pressure foot support configuration where movement of fluid through the first fluid line is enabled.

Clause 23. The article of footwear according to any one of Clauses 1 to 22, wherein when the first fluid line is in the closed configuration, the article of footwear is in a high pressure foot support configuration where movement of fluid through the first fluid line is disabled or inhibited.

Clause 24. The article of footwear according to any one of Clauses 1 to 23, wherein changing the first fluid line from the closed configuration to the open configuration via the closure element is accompanied by an increase in a height dimension of the fluid reservoir chamber.

Clause 25. The article of footwear according to any one of Clauses 1 to 23, wherein changing the first fluid line from the closed configuration to the open configuration via the closure element is accompanied by an increase in a height dimension of the sole structure.

Clause 26. The article of footwear according to any one of Clauses 1 to 15, further comprising: (i) a pump including an inlet and an outlet, wherein the inlet receives fluid from the foot support bladder chamber; and (ii) a second fluid line connected with the outlet and in fluid communication with the fluid reservoir chamber.

Clause 27. The article of footwear according to Clause 26, wherein the second fluid line extends between the outlet and the fluid reservoir chamber at a medial heel region of the article of footwear.

Clause 28. The article of footwear according to Clause 26 or 27, wherein the pump is a foot activated pump.

Clause 29. The article of footwear according to any one of Clauses 26 to 28, wherein when the closure element places the first fluid line in the closed configuration, activation of the pump moves fluid from the foot support bladder chamber to the fluid reservoir chamber, decreases fluid pressure in the foot support bladder chamber, and increases fluid pressure in the fluid reservoir chamber.

Clause 30. The article of footwear according to any one of Clauses 26 to 29, wherein the sole structure includes a midsole component located between the fluid reservoir chamber and the foot support bladder chamber.

Clause 31. The article of footwear according to Clause 30, wherein each of the first fluid line and the second fluid line extends around a sidewall of the midsole component.

Clause 32. The article of footwear according to Clause 31, wherein the first fluid line and the second fluid line are located adjacent one another at locations where the first fluid line and the second fluid line extend around the sidewall of the midsole component.

Clause 33. The article of footwear according to Clause 31, wherein the first fluid line and the second fluid line are joined together by a seam that extends between and defines interior chambers of each of the first fluid line and the second fluid line, wherein the seam is present at locations where the first fluid line and the second fluid line extend around the sidewall of the midsole component.

Clause 34. The article of footwear according to any one of Clauses 30 to 33, wherein a ground-facing surface of the midsole component includes: (a) a first support recess defined therein that supports an exterior surface of the first fluid line and (b) a second support recess defined therein that supports an exterior surface of the second fluid line.

Clause 35. The article of footwear according to any one of Clauses 30 to 33, wherein an upper-facing surface of the midsole component includes: (a) a first support recess defined therein that supports an exterior surface of the first fluid line and (b) a second support recess defined therein that supports an exterior surface of the second fluid line.

Clause 36. The article of footwear according to any one of Clauses 31 to 33, wherein an exterior surface of the sidewall of the midsole component includes: (a) a first support recess defined therein that supports an exterior surface of the first fluid line and (b) a second support recess defined therein that supports an exterior surface of the second fluid line.

Clause 37. The article of footwear according to any one of Clauses 31 to 33, wherein a first support recess is defined in the midsole component, wherein the first support recess extends continuously from a ground-facing surface of the midsole component, around the sidewall of the midsole component, and onto an upper-facing surface of the midsole component, and wherein an exterior surface of the first fluid line is received in the first support recess, and wherein a second support recess is defined in the midsole component, wherein the second support recess extends continuously from the ground-facing surface of the midsole component, around the sidewall of the midsole component, and onto the upper-facing surface of the midsole component, and wherein an exterior surface of the second fluid line is received in the second support recess.

Clause 38. The article of footwear according to Clause 36 or 37, wherein the first support recess and the second support recess are located adjacent one another.

Clause 39. The article of footwear according to Clause 36 or 37, wherein the first support recess and the second support recess are separated by a raised ridge of midsole material.

Clause 40. The article of footwear according to any one of Clauses 26 to 39, wherein the sole structure includes an outsole component engaged with the fluid reservoir chamber, wherein an upper-facing surface of the outsole component includes a first fluid line support surface and a second fluid line support surface.

Clause 41. The article of footwear according to Clause 40, wherein the first fluid line support surface and the second fluid line support surface are located adjacent one another.

Clause 42. The article of footwear according to Clause 40, wherein the first fluid line support surface and the second fluid line support surface are separated by a raised ridge of outsole material.

Clause 43. The article of footwear according to any one of Clauses 26 to 42, wherein each of the first fluid line and the second fluid line is exposed at an exterior surface of the sole structure.

Clause 44. The article of footwear according to any one of Clauses 26 to 42, wherein each of the first fluid line and the second fluid line is exposed at an exterior surface of the article of footwear.

Clause 45. The article of footwear according to any one of Clauses 1 to 44, wherein the fluid reservoir chamber includes a heel portion, a forefoot portion, and a midfoot portion located between the heel portion and the forefoot portion.

Clause 46. The article of footwear according to any one of Clauses 1 or 16 to 45, wherein the closure element comprises a clamp that is releasably engageable with the first fluid line.

Clause 47. The article of footwear according to any one of Clauses 1 or 16 to 45, wherein the closure element comprises a stopcock.

Clause 48. The article of footwear according to any one of Clauses 1 to 25, wherein the sole structure includes a midsole component located between the fluid reservoir chamber and the foot support bladder chamber.

Clause 49. The article of footwear according to Clause 48, wherein the first fluid line extends around a sidewall of the midsole component.

Clause 50. The article of footwear according to Clause 49, wherein a ground-facing surface of the midsole component includes a support recess defined therein that supports an exterior surface of the first fluid line.

Clause 51. The article of footwear according to Clause 49, wherein an upper-facing surface of the midsole component includes a support recess defined therein that supports an exterior surface of the first fluid line.

Clause 52. The article of footwear according to Clause 49, wherein an exterior surface of the sidewall of the midsole component includes a support recess defined therein that supports an exterior surface of the first fluid line.

Clause 53. The article of footwear according to Clause 49, wherein a first support recess portion is defined in a ground-facing surface of the midsole component, wherein a second support recess portion is defined in an upper-facing surface of the midsole component, and wherein an exterior surface of the first fluid line is received in the first support recess portion and the second support recess portion.

Clause 54. The article of footwear according to Clause 49, wherein a support recess is defined in the midsole component, wherein the support recess extends continuously from a ground-facing surface of the midsole component, around the sidewall of the midsole component, and onto an upper-facing surface of the midsole component, and wherein an exterior surface of the first fluid line is received in the support recess.

Clause 55. The article of footwear according to any one of Clauses 1 to 54, wherein the first fluid line is exposed at an exterior surface of the sole structure.

Clause 56. The article of footwear according to any one of Clauses 1 to 54, wherein the first fluid line is exposed at an exterior surface of the article of footwear.

Clause 57. The article of footwear according to any one of Clauses 1 to 56, wherein the sole structure includes an outsole component engaged with the fluid reservoir chamber, wherein an upper-facing surface of the outsole component includes a first fluid line support surface defined therein as a recessed area.

Clause 58. An article of footwear, comprising:

an upper including a medial heel region, a lateral heel region, and a rear heel region extending between the medial heel region and the lateral heel region;

a sole structure engaged with the upper, the sole structure including a foot support bladder chamber;

a fluid reservoir chamber;

a first fluid line extending between the foot support bladder chamber and the fluid reservoir chamber and placing the foot support bladder chamber in fluid communication with the fluid reservoir chamber; and a switch including a medial member pivotally engaged with the medial heel region, a lateral member pivotally engaged with the lateral heel region, and a contact portion extending around the rear heel region, wherein movement of the switch moves the contact portion to change the first fluid line between an open configuration and a closed configuration.

Clause 59. The article of footwear according to Clause 58, wherein the first fluid line extends rearward from a rear heel area of at least one of the foot support bladder chamber or the fluid reservoir chamber.

Clause 60. The article of footwear according to Clause 58 or 59, wherein the first fluid line extends through a flap that projects outward from a heel area of one of the foot support bladder chamber or the fluid reservoir chamber.

Clause 61. The article of footwear according to Clause 58 or 59, wherein the first fluid line extends through a flap that projects rearward from a rear heel area of the foot support bladder chamber.

Clause 62. The article of footwear according to Clause 60 or 61, wherein the flap includes: (a) a forward portion where a first end of the first fluid line receives fluid from the foot support bladder chamber and (b) a rearward portion forming a free end of the flap.

Clause 63. The article of footwear according to Clause 62, wherein the contact portion extends along a surface of the flap at a location between the forward portion and the rearward portion, and wherein movement of the switch causes the contact portion to induce movement of the rearward portion with respect to the forward portion.

Clause 64. The article of footwear according to Clause 62, wherein the contact portion extends along a surface of the flap at a location between the forward portion and the rearward portion, and wherein movement of the switch to change the first fluid line from the open configuration to the closed configuration moves the contact portion to create a pinched region in the first fluid line within the flap at a location between the rearward portion and the forward portion.

Clause 65. The article of footwear according to Clause 62, wherein the switch includes: (a) a medial side anchor point and (b) a lateral side anchor point, wherein the contact portion extends along a surface of the flap at a location between the forward portion and the rearward portion, and wherein movement of the switch causes the contact portion to induce movement of the rearward portion with respect to the forward portion.

Clause 66. The article of footwear according to Clause 62, wherein the switch includes: (a) a medial side anchor point and (b) a lateral side anchor point, wherein the contact portion extends along a surface of the flap at a location between the forward portion and the rearward portion, and wherein movement of the switch to change the first fluid line from the open configuration to the closed configuration moves the contact portion to create a pinched region in the first fluid line within the flap at a location between the rearward portion and the forward portion.

Clause 67. The article of footwear according to any one of Clauses 61 to 66, wherein a rear heel portion of at least one of the upper or the sole structure defines an opening or recess through which the flap extends.

Clause 68. The article of footwear according to any one of Clauses 58 to 67, further comprising: (i) a pump including an inlet and an outlet, wherein the inlet receives fluid from the fluid reservoir chamber; and (ii) a second fluid line connected with the outlet and in fluid communication with the foot support bladder chamber.

Clause 69. The article of footwear according to Clause 68, wherein the second fluid line extends between the outlet and the foot support bladder chamber at a medial heel area of the article of footwear.

Clause 70. The article of footwear according to Clause 68 or 69, wherein the pump is a foot activated pump.

Clause 71. The article of footwear according to any one of Clauses 68 to 70, wherein when the switch places the first fluid line in the closed configuration, activation of the pump moves fluid from the fluid reservoir chamber to the foot support bladder chamber, decreases fluid pressure in the fluid reservoir chamber, and increases fluid pressure in the foot support bladder chamber.

Clause 72. The article of footwear according to Clause 71, wherein sufficient reduction in the fluid pressure in the fluid reservoir chamber induces a decrease in a height dimension of the fluid reservoir chamber.

Clause 73. The article of footwear according to Clause 71, wherein sufficient reduction in the fluid pressure in the fluid reservoir chamber induces a decrease in a height dimension of the sole structure.

Clause 74. The article of footwear according to any one of Clauses 68 to 73, wherein the sole structure includes a midsole component located between the fluid reservoir chamber and the foot support bladder chamber.

Clause 75. The article of footwear according to Clause 74, wherein each of the first fluid line and the second fluid line extends around a sidewall of the midsole component.

Clause 76. The article of footwear according to Clause 75, wherein the first fluid line and the second fluid line are located adjacent one another at locations where the first fluid line and the second fluid line extend around the sidewall of the midsole component.

Clause 77. The article of footwear according to Clause 75, wherein the first fluid line and the second fluid line are joined together by a seam that extends between and defines interior chambers of each of the first fluid line and the second fluid line, wherein the seam is present at locations where the first fluid line and the second fluid line extend around the sidewall of the midsole component.

Clause 78. The article of footwear according to any one of Clauses 74 to 77, wherein a ground-facing surface of the midsole component includes: (a) a first support recess defined therein that supports an exterior surface of the first fluid line and (b) a second support recess defined therein that supports an exterior surface of the second fluid line.

Clause 79. The article of footwear according to any one of Clauses 74 to 77, wherein an upper-facing surface of the midsole component includes: (a) a first support recess defined therein that supports an exterior surface of the first fluid line and (b) a second support recess defined therein that supports an exterior surface of the second fluid line.

Clause 80. The article of footwear according to any one of Clauses 75 to 77, wherein an exterior surface of the sidewall of the midsole component includes: (a) a first support recess defined therein that supports an exterior surface of the first fluid line and (b) a second support recess defined therein that supports an exterior surface of the second fluid line.

Clause 81. The article of footwear according to any one of Clauses 75 to 77, wherein a first support recess is defined in the midsole component, wherein the first support recess extends continuously from a ground-facing surface of the midsole component, around the sidewall of the midsole component, and onto an upper-facing surface of the midsole component, and wherein an exterior surface of the first fluid line is received in the first support recess, and wherein a second support recess is defined in the midsole component, wherein the second support recess extends continuously from the ground-facing surface of the midsole component, around the sidewall of the midsole component, and onto the upper-facing surface of the midsole component, and wherein an exterior surface of the second fluid line is received in the second support recess.

Clause 82. The article of footwear according to Clause 80 or 81, wherein the first support recess and the second support recess are located adjacent one another.

Clause 83. The article of footwear according to Clause 80 or 81, wherein the first support recess and the second support recess are separated by a raised ridge of midsole material.

Clause 84. The article of footwear according to any one of Clauses 68 to 83, wherein the sole structure includes an outsole component engaged with the fluid reservoir chamber, wherein an upper-facing surface of the outsole component includes a first fluid line support surface and a second fluid line support surface.

Clause 85. The article of footwear according to Clause 84, wherein the first fluid line support surface and the second fluid line support surface are located adjacent one another.

Clause 86. The article of footwear according to Clause 84, wherein the first fluid line support surface and the second fluid line support surface are separated by a raised ridge of outsole material.

Clause 87. The article of footwear according to any one of Clauses 68 to 86, wherein each of the first fluid line and the second fluid line is exposed at an exterior surface of the sole structure.

Clause 88. The article of footwear according to any one of Clauses 68 to 86, wherein each of the first fluid line and the second fluid line is exposed at an exterior surface of the article of footwear.

Clause 89. The article of footwear according to any one of Clauses 58 to 88, wherein when the first fluid line is in the open configuration, the article of footwear is in a low pressure foot support configuration where movement of fluid through the first fluid line is enabled.

Clause 90. The article of footwear according to any one of Clauses 58 to 89, wherein when the first fluid line is in the closed configuration, the article of footwear is in a high pressure foot support configuration where movement of fluid through the first fluid line is disabled or inhibited.

Clause 91. The article of footwear according to any one of Clauses 58 to 90, wherein movement of the switch to change the first fluid line from the closed configuration to the open configuration is accompanied by an increase in a height dimension of the fluid reservoir chamber.

Clause 92. The article of footwear according to any one of Clauses 58 to 91, wherein movement of the switch to change the first fluid line from the closed configuration to the open configuration is accompanied by an increase in a height dimension of the sole structure.

Clause 93. The article of footwear according to any one of Clauses 58 to 92, wherein the fluid reservoir chamber includes a heel portion, a forefoot portion, and a midfoot portion located between the heel portion and the forefoot portion.

Clause 94. The article of footwear according to any one of Clauses 58 to 93, wherein the upper includes a heel component that includes an exterior surface that defines a recess, and wherein at least a portion of the switch is located in the recess.

Clause 95. The article of footwear according to Clause 94, wherein the recess is sized and shaped such that at least the portion of the switch is located in the recess when the switch places the first fluid line in both of the open configuration and the closed configuration.

Clause 96. The article of footwear according to any one of Clauses 58 to 95, wherein the contact portion of the switch extends beneath the first fluid line.

Clause 97. The article of footwear according to any one of Clauses 58 to 95, wherein the contact portion of the switch extends above the first fluid line.

Clause 98. The article of footwear according to any one of Clauses 58 to 95, wherein the contact portion of the switch includes a top portion that extends above the first fluid line and a bottom portion that extends beneath the first fluid line.

Clause 99. The article of footwear according to any one of Clauses 58 to 67, wherein the sole structure includes a midsole component located between the fluid reservoir chamber and the foot support bladder chamber.

Clause 100. The article of footwear according to Clause 99, wherein the first fluid line extends around a sidewall of the midsole component.

Clause 101. The article of footwear according to Clause 100, wherein a ground-facing surface of the midsole component includes a support recess defined therein that supports an exterior surface of the first fluid line.

Clause 102. The article of footwear according to Clause 100, wherein an upper-facing surface of the midsole component includes a support recess defined therein that supports an exterior surface of the first fluid line.

Clause 103. The article of footwear according to Clause 100, wherein an exterior surface of the sidewall of the midsole component includes a support recess defined therein that supports an exterior surface of the first fluid line.

Clause 104. The article of footwear according to Clause 100, wherein a first support recess portion is defined in a ground-facing surface of the midsole component, wherein a second support recess portion is defined in an upper-facing surface of the midsole component, and wherein an exterior surface of the first fluid line is received in the first support recess portion and the second support recess portion.

Clause 105. The article of footwear according to Clause 100, wherein a support recess is defined in the midsole component, wherein the support recess extends continuously from a ground-facing surface of the midsole component, around the sidewall of the midsole component, and onto an upper-facing surface of the midsole component, and wherein an exterior surface of the first fluid line is received in the support recess.

Clause 106. The article of footwear according to any one of Clauses 58 to 105, wherein the first fluid line is exposed at an exterior surface of the sole structure.

Clause 107. The article of footwear according to any one of Clauses 58 to 105, wherein the first fluid line is exposed at an exterior surface of the article of footwear.

Clause 108. The article of footwear according to any one of Clauses 58 to 67 or 87 to 107, wherein the sole structure includes an outsole component engaged with the fluid reservoir chamber, wherein an upper-facing surface of the outsole component includes a first fluid line support surface defined therein as a recessed area.

Clause 109. The article of footwear according to any one of Clauses 58 to 108, further comprising a heel component fixed to at least one of the upper or the sole structure, wherein the switch is movably mounted to the heel component.

Clause 110. The article of footwear according to Clause 109, wherein the heel component includes a latching member, wherein the latching member engages a portion of the switch to hold the switch in one of the open configuration or the closed configuration.

Clause 111. A foot support system, comprising:

a first sole member including a first upper-facing surface and a first ground-facing surface;

a first bladder portion including a second upper-facing surface and a second ground-facing surface, wherein the second ground-facing surface extends over the first upper-facing surface;

a second sole member including a third upper-facing surface, a third ground-facing surface, and a sidewall extending between the third upper-facing surface and the third ground-facing surface, wherein the third ground-facing surface extends over the second upper-facing surface;

a second bladder portion including a fourth upper-facing surface and a fourth ground-facing surface, wherein the fourth ground-facing surface extends over the third upper-facing surface; and a first fluid line extending from the first bladder portion to the second bladder portion, wherein one of the first upper-facing surface, the third ground-facing surface, the sidewall, or the third upper-facing surface includes a first recessed surface defined therein, wherein an outer surface of the first fluid line is received in the first recessed surface.

Clause 112. The foot support system according to Clause 111, wherein the first recessed surface is defined in the third ground-facing surface, wherein the first upper-facing surface includes a second recessed surface defined therein located to face the first recessed surface, and wherein the first fluid line extends through a channel defined between the first recessed surface and the second recessed surface.

Clause 113. The foot support system according to Clause 111, further comprising a footwear component having a fifth ground-facing surface, wherein the fifth ground-facing surface extends over the fourth upper-facing surface.

Clause 114. The foot support system according to Clause 113, wherein the first recessed surface is defined in the third upper-facing surface, wherein the fifth ground-facing surface includes a second recessed surface defined therein located to face the first recessed surface, and wherein the first fluid line extends through a channel defined between the first recessed surface and the second recessed surface.

Clause 115. The foot support system according to Clause 113 or 114, wherein the footwear component comprises a heel counter.

Clause 116. The foot support system according to any one of Clauses 111 to 114, wherein the first recessed surface extends continuously along a portion of the third ground-facing surface, around the sidewall, and along a portion of the third upper-facing surface.

Clause 117. The foot support system according to any one of Clauses 111 to 116, wherein the first recessed surface is defined at least in the sidewall.

Clause 118. The foot support system according to any one of Clauses 111 to 116, wherein the first recessed surface is defined at least in the sidewall at a medial side of the second sole member.

Clause 119. The foot support system according to any one of Clauses 111 to 116, wherein the first recessed surface is defined at least in the sidewall at a medial side in a heel region of the second sole member.

Clause 120. The foot support system according to Clause 111, wherein the first recessed surface is defined in the first upper-facing surface.

Clause 121. The foot support system according to Clause 111, wherein the first recessed surface is defined in the third ground-facing surface.

Clause 122. The foot support system according to Clause 111, wherein the first recessed surface is defined in the third upper-facing surface.

Clause 123. A foot support system, comprising:

a first sole member including a first upper-facing surface and a first ground-facing surface;

a first bladder portion including a second upper-facing surface and a second ground-facing surface, wherein the second ground-facing surface extends over the first upper-facing surface;

a second sole member including a third upper-facing surface, a third ground-facing surface, and a sidewall extending between the third upper-facing surface and the third ground-facing surface, wherein the third ground-facing surface extends over the second upper-facing surface;

a second bladder portion including a fourth upper-facing surface and a fourth ground-facing surface, wherein the fourth ground-facing surface extends over the third upper-facing surface;

a first fluid line extending from the first bladder portion to the second bladder portion; and a second fluid line extending from the first bladder portion to the second bladder portion, wherein one of the first upper-facing surface, the third ground-facing surface, the sidewall, or the third upper-facing surface includes: (i) a first recessed surface defined therein, wherein an outer surface of the first fluid line is received in the first recessed surface, and (ii) a second recessed surface defined therein, wherein an outer surface of the second fluid line is received in the second recessed surface.

Clause 124. The foot support system according to Clause 123, wherein the first recessed surface and the second recessed surface are defined in the third ground-facing surface, wherein the first upper-facing surface includes a third recessed surface defined therein located to face the first recessed surface and a fourth recessed surface defined therein located to face the second recessed surface, wherein the first fluid line extends through a first channel defined between the first recessed surface and the third recessed surface, and wherein the second fluid line extends through a second channel defined between the second recessed surface and the fourth recessed surface.

Clause 125. The foot support system according to Clause 123, further comprising a footwear component having a fifth ground-facing surface, wherein the fifth ground-facing surface extends over the fourth upper-facing surface.

Clause 126. The foot support system according to Clause 125, wherein the first recessed surface and the second recessed surface are defined in the third upper-facing surface, wherein the fifth ground-facing surface includes a third recessed surface defined therein located to face the first recessed surface and a fourth recessed surface defined therein located to face the second recessed surface, wherein the first fluid line extends through a channel defined between the first recessed surface and the third recessed surface, and wherein the second fluid line extends through a second channel defined between the second recessed surface and the fourth recessed surface.

Clause 127. The foot support system according to Clause 125 or 126, wherein the footwear component comprises a heel counter.

Clause 128. The foot support system according to any one of Clauses 123 to 127, wherein each of the first recessed surface and the second recessed surface extends continuously along a portion of the third ground-facing surface, around the sidewall, and along a portion of the third upper-facing surface.

Clause 129. The foot support system according to any one of Clauses 123 to 128, wherein each of the first recessed surface and the second recessed surface is defined at least in the sidewall.

Clause 130. The foot support system according to any one of Clauses 123 to 129, wherein each of the first recessed surface and the second recessed surface is defined at least in the sidewall at a medial side of the second sole member.

Clause 131. The foot support system according to any one of Clauses 123 to 129, wherein each of the first recessed surface and the second recessed surface is defined at least in the sidewall at a medial side in a heel region of the second sole member.

Clause 132. The foot support system according to Clause 123, wherein each of the first recessed surface and the second recessed surface is defined in the first upper-facing surface.

Clause 133. The foot support system according to Clause 123, wherein each of the first recessed surface and the second recessed surface is defined in the third ground-facing surface.

Clause 134. The foot support system according to Clause 123, wherein each of the first recessed surface and the second recessed surface is defined in the third upper-facing surface.

Clause 135. The foot support system according to any one of Clauses 123 to 134, wherein the first recessed surface and the second recessed surface are located adjacent one another.

Clause 136. The foot support system according to any one of Clauses 123 to 135, wherein the first sole member comprises an outsole.

Clause 137. The foot support system according to any one of Clauses 123 to 136, wherein the second sole member comprises a midsole.

Clause 138. The foot support system according to Clause 137, wherein the first recessed surface is defined in a foam material forming the sidewall of the second sole member.

Clause 139. A foot support system, comprising:

a first bladder portion including a first upper-facing surface and a first ground-facing surface;

a first sole member including a second upper-facing surface, a second ground-facing surface, and a sidewall extending between the second upper-facing surface and the second ground-facing surface, wherein the second ground-facing surface extends over the first upper-facing surface;

a second bladder portion including a third upper-facing surface and a third ground-facing surface, wherein the third ground-facing surface extends over the second upper-facing surface;

a footwear component having a fourth ground-facing surface, wherein the fourth ground-facing surface extends over the third upper-facing surface; and a first fluid line extending from the first bladder portion to the second bladder portion, wherein one of the second ground-facing surface, the sidewall, the second upper-facing surface, or the fourth ground-facing surface includes a first recessed surface defined therein, wherein an outer surface of the first fluid line is received in the first recessed surface.

Clause 140. A foot support system, comprising:

a first bladder portion including a first upper-facing surface and a first ground-facing surface;

a first sole member including a second upper-facing surface, a second ground-facing surface, and a sidewall extending between the second upper-facing surface and the second ground-facing surface, wherein the second ground-facing surface extends over the first upper-facing surface;

a second bladder portion including a third upper-facing surface and a third ground-facing surface, wherein the third ground-facing surface extends over the second upper-facing surface;

a footwear component having a fourth ground-facing surface, wherein the fourth ground-facing surface extends over the third upper-facing surface;

a first fluid line extending from the first bladder portion to the second bladder portion; and a second fluid line extending from the first bladder portion to the second bladder portion, wherein one of the second ground-facing surface, the sidewall, the second upper-facing surface, or the fourth ground-facing surface includes: (i) a first recessed surface defined therein, wherein an outer surface of the first fluid line is received in the first recessed surface, and (ii) a second recessed surface defined therein, wherein an outer surface of the second fluid line is received in the second recessed surface.

Clause 141. A sole structure, comprising a foot support system according to any one of Clauses 111 to 140.

Clause 142. An article of footwear, comprising: (a) an upper; and (b) a foot support system according to any one of Clauses 111 to 140 engaged with the upper.

What is claimed is:

1. An article of footwear, comprising:

an upper formed from one or more component parts;

a sole structure engaged with the upper, the sole structure including a foot support bladder chamber and a midsole component;

a fluid reservoir chamber, wherein the midsole component is located between the fluid reservoir chamber and the foot support bladder chamber;

a first fluid line extending between the foot support bladder chamber and the fluid reservoir chamber and placing the foot support bladder chamber in fluid communication with the fluid reservoir chamber, wherein the first fluid line extends outward from a heel area or a midfoot area of at least one of the foot support bladder chamber or the fluid reservoir chamber, and wherein the first fluid line extends around a sidewall of the midsole component; and a closure element for changing the first fluid line between an open configuration and a closed configuration.

2. The article of footwear according to claim 1, wherein the first fluid line extends through a flap that projects outward from a heel area of one of the foot support bladder chamber or the fluid reservoir chamber, wherein the flap includes: (a) a forward portion where a first end of the first fluid line receives fluid from one of the foot support bladder chamber or the fluid reservoir chamber and (b) a rearward portion forming a free end of the flap.

3. The article of footwear according to claim 2, wherein the closure element comprises a switch mounted at a heel region of the upper, wherein the switch includes a contact portion that extends along a surface of the flap at a location between the forward portion and the rearward portion, and wherein movement of the switch to change the first fluid line from the open configuration to the closed configuration moves the contact portion to create a pinched region in the first fluid line at a location between the rearward portion and the forward portion.

4. The article of footwear according to claim 2, wherein the closure element comprises a switch, wherein the switch includes: (a) a medial side anchor point, (b) a lateral side anchor point, and (c) a contact portion extending along a surface of the flap at a location between the forward portion and the rearward portion, and wherein movement of the switch to change the first fluid line from the open configuration to the closed configuration moves the contact portion to create a pinched region in the first fluid line at a location between the rearward portion and the forward portion.

5. An article of footwear, comprising:

an upper formed from one or more component parts;

a sole structure engaged with the upper, the sole structure including a foot support bladder chamber;

a fluid reservoir chamber;

a first fluid line extending between the foot support bladder chamber and the fluid reservoir chamber and placing the foot support bladder chamber in fluid communication with the fluid reservoir chamber, wherein the first fluid line extends outward from a heel area or a midfoot area of at least one of the foot support bladder chamber or the fluid reservoir chamber, wherein the first fluid line extends through a flap that projects outward from a heel area of one of the foot support bladder chamber or the fluid reservoir chamber, and wherein the flap includes: (a) a forward portion where a first end of the first fluid line receives fluid from one of the foot support bladder chamber or the fluid reservoir chamber and (b) a rearward portion forming a free end of the flap;

a closure element for changing the first fluid line between an open configuration and a closed configuration, wherein the closure element comprises a switch, wherein the switch includes: (a) a medial side anchor point, (b) a lateral side anchor point, and (c) a contact portion extending along a surface of the flap at a location between the forward portion and the rearward portion, and wherein movement of the switch to change the first fluid line from the open configuration to the closed configuration moves the contact portion to create a pinched region in the first fluid line at a location between the rearward portion and the forward portion; and a heel component fixed to at least one of the upper or the sole structure, wherein the switch is movably mounted to the heel component, wherein the heel component includes a latching member, and wherein the latching member engages a portion of the switch to hold the closure element in one of the open configuration or the closed configuration.

6. The article of footwear according to claim 5, wherein the sole structure includes a midsole component located between the fluid reservoir chamber and the foot support bladder chamber, wherein the first fluid line extends around a sidewall of the midsole component.

7. The article of footwear according to claim 1, wherein a first support recess portion is defined in a ground-facing surface of the midsole component, wherein a second support recess portion is defined in an upper-facing surface of the midsole component, and wherein an exterior surface of the first fluid line is received in the first support recess portion and the second support recess portion.

8. The article of footwear according to claim 1, wherein a support recess is defined in the midsole component, wherein the support recess extends continuously from a ground-facing surface of the midsole component, around the sidewall of the midsole component, and onto an upper-facing surface of the midsole component, and wherein an exterior surface of the first fluid line is received in the support recess.

9. The article of footwear according to claim 1, wherein the sole structure includes an outsole component engaged with the fluid reservoir chamber, wherein an upper-facing surface of the outsole component includes a first fluid line support surface defined therein as a recessed area.

10. An article of footwear, comprising:

an upper including a medial heel region, a lateral heel region, and a rear heel region extending between the medial heel region and the lateral heel region;

a sole structure engaged with the upper, the sole structure including a foot support bladder chamber;

a fluid reservoir chamber;

a first fluid line extending between the foot support bladder chamber and the fluid reservoir chamber and placing the foot support bladder chamber in fluid communication with the fluid reservoir chamber; and a switch including a medial member pivotally engaged with the medial heel region, a lateral member pivotally engaged with the lateral heel region, and a contact portion extending around the rear heel region, wherein movement of the switch moves the contact portion to change the first fluid line between an open configuration and a closed configuration.

11. The article of footwear according to claim 10, wherein the first fluid line extends through a flap that projects outward from a heel area of one of the foot support bladder chamber or the fluid reservoir chamber, wherein the flap includes: (a) a forward portion where a first end of the first fluid line receives fluid from the foot support bladder chamber and (b) a rearward portion forming a free end of the flap.

12. The article of footwear according to claim 11, wherein the contact portion extends along a surface of the flap at a location between the forward portion and the rearward portion, and wherein movement of the switch to change the first fluid line from the open configuration to the closed configuration moves the contact portion to create a pinched region in the first fluid line within the flap at a location between the rearward portion and the forward portion.

13. The article of footwear according to claim 11, wherein the switch includes: (a) a medial side anchor point and (b) a lateral side anchor point, wherein the contact portion extends along a surface of the flap at a location between the forward portion and the rearward portion, and wherein movement of the switch to change the first fluid line from the open configuration to the closed configuration moves the contact portion to create a pinched region in the first fluid line within the flap at a location between the rearward portion and the forward portion.

14. The article of footwear according to claim 10, wherein the sole structure includes a midsole component located between the fluid reservoir chamber and the foot support bladder chamber, wherein the first fluid line extends around a sidewall of the midsole component.

15. The article of footwear according to claim 14, wherein a ground-facing surface of the midsole component includes a support recess defined therein that supports an exterior surface of the first fluid line; and/or wherein an upper-facing surface of the midsole component includes a support recess defined therein that supports an exterior surface of the first fluid line; and/or wherein an exterior surface of the sidewall of the midsole component includes a support recess defined therein that supports an exterior surface of the first fluid line.

16. The article of footwear according to claim 14, wherein a first support recess portion is defined in a ground-facing surface of the midsole component, wherein a second support recess portion is defined in an upper-facing surface of the midsole component, and wherein an exterior surface of the first fluid line is received in the first support recess portion and the second support recess portion.

17. The article of footwear according to claim 14, wherein a support recess is defined in the midsole component, wherein the support recess extends continuously from a ground-facing surface of the midsole component, around the sidewall of the midsole component, and onto an upper-facing surface of the midsole component, and wherein an exterior surface of the first fluid line is received in the support recess.

18. The article of footwear according to claim 10, further comprising a heel component fixed to at least one of the upper or the sole structure, wherein the switch is movably mounted to the heel component, wherein the heel component includes a latching member, and wherein the latching member engages a portion of the switch to hold the switch in one of the open configuration or the closed configuration.

19. A foot support system, comprising:

a first sole member including a first upper-facing surface and a first ground-facing surface;

a first bladder portion including a second upper-facing surface and a second ground-facing surface, wherein the second ground-facing surface extends over the first upper-facing surface;

a second sole member including a third upper-facing surface, a third ground-facing surface and a sidewall extending between the third upper-facing surface and the third ground-facing surface, wherein the third ground-facing surface extends over the second upper-facing surface;

a second bladder portion including a fourth upper-facing surface and a fourth ground-facing surface, wherein the fourth ground-facing surface extends over the third upper-facing surface; and a first fluid line extending from the first bladder portion to the second bladder portion, wherein one of the first upper-facing surface, the third ground-facing surface, the sidewall, or the third upper-facing surface includes a first recessed surface defined therein, wherein an outer surface of the first fluid line is received in the first recessed surface.

20. The foot support system according to claim 19, further comprising a footwear component having a fifth ground-facing surface, wherein the fifth ground-facing surface extends over the fourth upper-facing surface, wherein the first recessed surface is defined in the third upper-facing surface, wherein the fifth ground-facing surface includes a second recessed surface defined therein located to face the first recessed surface, and wherein the first fluid line extends through a channel defined between the first recessed surface and the second recessed surface.

* * * * *